US005279700A

United States Patent [19]

Retti

[11] Patent Number: 5,279,700

[45] Date of Patent: Jan. 18, 1994

[54] AUTOMATED WALLBOARD TAPING APPARATUS AND PROCESS THEREFOR

[75] Inventor: Kahrl L. Retti, Timonium, Md.

[73] Assignee: Drywall Technologies, Inc., Glen Burnie, Md.

[21] Appl. No.: 696,131

[22] Filed: May 6, 1991

Related U.S. Application Data

[60] Continuation-in-part of Ser. No. 518,320, May 7, 1990, Pat. No. 5,013,389, which is a division of Ser. No. 695,098, May 3, 1991.

[51] Int. Cl.[5] ..... B32B 31/00

[52] U.S. Cl. ..... 156/578; 156/356; 156/357; 156/526; 156/547; 156/575; 118/679

[58] Field of Search ..... 156/356, 357, 361, 523, 156/524, 526, 531, 547, 549, 575, 577, 578, 579; 118/410, 676, 677, 679, 683

[56] References Cited

U.S. PATENT DOCUMENTS

| | | | |
|---|---|---|---|
| 3,707,427 | 12/1972 | Erickson | 118/410 X |
| 3,960,643 | 6/1976 | Dargitz et al. | 156/526 X |
| 4,105,490 | 8/1978 | Lass | 156/526 |
| 4,127,434 | 11/1978 | Lass | 156/526 |
| 4,569,864 | 2/1986 | McIntyre | 118/679 X |
| 4,689,107 | 8/1987 | Entwistle | 156/524 X |
| 4,775,442 | 10/1988 | Januska | 156/577 X |

*Primary Examiner*—David A. Simmons
*Assistant Examiner*—James J. Engel, Jr.
*Attorney, Agent, or Firm*—Sherman and Shalloway

[57] ABSTRACT

An apparatus for taping joints between pieces of wallboard comprises a taping head, slidingly contactable with a wall, for substantially simultaneously applying a first layer of a joint compound to a joint between pieces of wallboard, embedding a wallboard tape in the first layer of the joint compound, and overcoating the embedded wallboard tape with at least one additional layer of the joint compound; a handle, connected to the taping head, for supporting the taping head, the handle being manually graspable by an operator, the handle having a fluid conduit formed therein for passing joint compound to the taping head; a tape supply mounted on the handle for supplying wallboard tape to the taping head; a backpack, wearable by the operator, for supporting a supply of the joint compound and for producing a pressurized stream of the joint compound; and a flexible connecting means for fluidically interconnecting the backpack and the fluid conduit to pass the pressurized stream of the joint compound from the backpack to the fluid conduit.

22 Claims, 16 Drawing Sheets

AUTOMATED WALLBOARD TAPING APPARATUS AND PROCESS THEREFOR

REFERENCE TO RELATED APPLICATIONS

This application is a continuation-in-part of my application Ser. No. 07/518,320 filed May 7, 1990 now U.S. Pat. No. 5,013,389, and divisional application Ser. No. 07/695,098 filed May 3, 1991.

BACKGROUND OF THE INVENTION

1. Field Of The Invention

The present invention is directed to an automated process of taping joints between adjacent pieces of wallboard and an automated apparatus for effecting such taping of the joints. More particularly, the present invention is directed to an automated process and apparatus whereby a superior finished joint between adjacent pieces of wallboard may be completed in one step.

2. Description Of The Prior Art

Wallboard (also known as drywall) has become the dominant material in the production of interior building partitions. In particular, interior building partitions generally comprise a studwall of spaced parallel vertical members (studs) which are used as a support for preformed panels (wallboard) which are attached to the studwall by screws, nails, adhesive or any other conventional attachment system. Obviously, joints exist between adjacent preformed panels In order to provide a continuous flat surface to the wall, it is necessary to "finish" the joint between adjacent panels Generally, such "finishing" requires the building up of multiple layers of a mastic material (joint compound) and the blending of this joint compound into the panel surface so as to form the desired flat and contiguous wall surface. In order to facilitate this finishing of the joints, most manufacturers bevel the longitudinal edges of the wallboard panels so as to allow a buildup of mastic material which will then match the level of the major surface area of the preformed panel. Typically, the buildup of the mastic material in the joint area comprises the application of a first layer of mastic material, the embedding of a wallboard tape (for example a paper tape or a fiberglass tape) in the first layer of mastic material and then the overcoating of the tape with one or more, generally two layers of additional mastic material. This finishing of the joints is a time consuming process, since it is generally necessary to wait 24 hours between each application of a coat of mastic material in order to allow the coat to dry before the application of an overcoat of an additional layer of mastic material. Moreover, it is then necessary generally to sand the joint area so as to produce a finish which will match the major portion of the surface area of the wallboard panels. The "finishing" process thus is both time-consuming and labor-intensive.

In this regard, numerous attempts have been made to speed up and/or reduce the labor involved in the finishing products. In this regard, attention is directed to U.S. Pat. Nos. 2,666,323 and 2,824,442, to Ames, which disclose a tool designed to apply a layer of mastic to a wallboard joint.

U.S. Pat. No. 3,007,837, to Goode, Jr., discloses a tape and joint compound dispensing wallboard taping machine which uses air pressure to supply joint compound to the head of the tool where it is applied to one side of the tape which side of the tape is then applied to the wall.

U.S. Pat. No. 3,131,108, to Kennard, discloses a wallboard taping machine which may have interchangeable e heads (or different conditions, e.g. flat joints versus corner joints.

U.S. Pat. No. 3,343,202, to Ames, discloses a tool for applying mastic to wallboard which includes a swingable arcuate trawling blade.

U.S. Pat. No. 3,404,060, to Taylor, Jr., discloses a wallboard taping machine including a supply of both joint compound and tape. The device includes a tape cutting knife which is automatically retractable and the tape has the joint compound applied on one side thereof.

U.S. Pat. No. 3,707,427, to Erickson, discloses a tape and joint compound dispenser wherein the tape is drawn through a joint compound reservoir so that the joint compound is applied on one side thereof. The quantity of joint compound in the dispensing chamber is automatically regulated.

U.S. Pat. No. 3,880,701, to Moree, discloses a tape and joint applying tool including applicator rolls and a blade for cutting the tape.

U.S. Pat. No. 3,925,145 discloses a tool for embedding tape into mastic at the corner of a room after the mastic and tape have been previously applied to the corner joint of the room.

U.S. Pat. No. 3,960,643, to Dargitz et al., discloses a device to apply a tape and covering finish plaster to a drywall seam in a single pass lengthwise thereover, wherein a relatively lightweight, hand supported frame has a unit thereon operative to first apply glue to a length of tape and then glue-affix the tape to the drywall over the seam and another unit on the frame operative, but trailing the tape gluing and applying unit, the apply a thin, smooth, layer of joint compound over the then-in-place tape.

U.S. Pat. No. 4,080,240 to Dysart, discloses a device for applying tape to wallboard and including valve-controlled mud supply. The device also includes a severing knife and a retractable V-shaped roller.

U.S. Pat. No. 4,086,121, to Ames, discloses a self-contained drywall taper having a hollow elongated body for holding mastic and supports a roll of tape with tape feeding means to deliver the tape to tape applying wheels then in turn apply it to cover a joint between two wallboard sections . A piston is slidably mounted in the hollow body and is automatically moved by a mechanism actuated by the rotating wheels, as they are moved over the wallboard surface, to force a layer of mastic onto the tape just prior to it being applied to the surface.

U.S. Pat. No. 4,090,914, to Hauk et al., discloses an apparatus for applying tape and adhesive to wallboard joints which is then convertible to deposit adhesive over the previously applied tape.

U.S. Pat. No. 4,196,028, to Mills, discloses a joint compound and tape applying tool having the provision of a following corner roller.

U.S. Pat. No. 4,208,239, to Lass, discloses a drywall taping machine including a flexible resilient wiper blade which presses the cement-laden tape into engagement with the wall and, in addition, feathers the cement onto the drywall along both side edges of the tape in a single pass. A backpack support for the joint compound supply is disclosed.

U.S. Pat. No. 4,309,238, to Hauk, discloses a drywall taping device which has a control for adjusting the tensioning force applied to toothed traction wheels thereof.

U.S. Pat. No. 4,358,337, to Johnson et al., discloses a tape applicator which utilizes a replaceable joint compound cartridge system.

U.S. Pat. No. 4,452,663, discloses a wallboard joint taping apparatus including an elongated frame having a tape press wheel mounted on the forward end with a compound reservoir mounted on the frame, intermediate the ends, with aligned slots through the lower edge of the wall with a source of tape mounted on the other end of the frame with the tape passing through the slots in the compound container for picking up taping compound on the surface thereof and passing over the roller for application and pressing by the press wheel into a joint between adjacent wallboard panels.

U.S. Pat. No. 4,516,868, to Molnar, discloses a device designed to apply a layer of joint compound over an already installed length of tape.

U.S. Pat. No. 4,592,797, to Carlson, discloses a tube including a cylindrical roller for applying pressure to embed a tape in adhesive, the roller being designed to allow the mud which is on (he underside of the tape to flow over the top of the tape and coat that surface as well.

U.S. Pat. No. 4,608,116, to Braselton, discloses a baseboard edge taping tool which includes a severing knife and which is specifically designed to enable cutting operations at a corner.

Other references relating to tape dispensing and mastic dispensing include U.S. Pat. No. 2,972,428, to Dubbs, which discloses a tape applicator including microswitch controls for advancing, severing and applying a pressure sensitive tape. Movements of the tape are controlled incrementally on a cyclicable basis.

U.S. Pat. No. 3,785,535, to Ames, discloses a mastic supply pump outlet for filling different types of mastic-applying tools.

U.S. Pat. No. 4,406,247, to Baughman et al., discloses control of the flow of adhesive in an adhesive dispensing system wherein a logic control unit receives signals indicative of various process conditions and in response thereto controls. adhesive dispensing.

U.S. Pat. No. 4,477,304, to Westermann, discloses a tool designed to apply a predetermined quantity of adhesive on a workpiece.

U.S. Pat. No. 4,584,047, to Vanderpool et al., discloses a hand-held labeling device which senses the position of the web of labels and controls other operation in response to this sensed condition.

Despite the great efforts which have been applied to reduce the labor and time involved in wallboard finishing, there is still a marked need for an efficient and useful tool which is easy to operate and which will allow a one-step finishing of wallboard.

SUMMARY OF THE INVENTION

Accordingly, it is an object of the present invention to provide a process for wallboard finishing which requires only a single step.

It is a further object of the present invention to provide an apparatus for effecting such a single step process.

As will become readily apparent hereinafter, the above objects of the invention are achieved by the provision of a method for taping joints between pieces of wallboard comprising the substantially simultaneous steps of: (a) applying a first layer of a joint compound to a joint between pieces of wallboard, the first layer of the joint compound having a first predetermined width, the first layer of the joint compound being substantially centered, widthwise, on the joint; (b) embedding a wallboard tape in the first layer of the joint compound, the wallboard tape having a width substantially equal to the first predetermined width, the wallboard tape being substantially. centered, widthwise, on the joint; (c) overcoating the embedded wallboard tape with at least one additional layer of the joint compound, the at least one additional layer of the joint compound having a width greater than the first predetermined width, the at least one additional layer of the joint compound being substantially centered, widthwise, on the joint.

In a preferred embodiment of the method of the present invention, the step (c) comprises the substantially simultaneous sub-steps of: (c-1) overcoating the embedded wallboard tape with a second layer of the joint compound, the second layer of the joint compound having a second predetermined width, the second predetermined width being greater than the first predetermined width, the second layer of the joint compound being substantially centered, widthwise, on the joint; and (c-2) overcoating the second layer if the joint compound with a third layer of the joint compound, the third layer of the joint compound having a third predetermined width, the third predetermined width being greater than the second predetermined width, the third layer of the joint compound being substantially centered, widthwise, on the joint.

In a particularly preferred embodiment of the present method, the method comprises the further step (d) of imprinting a surface pattern on the third layer of the joint compound, preferably, the surface pattern matches a surface pattern on the wallboard.

The present invention also provides a novel joint compound, which is quick-setting, so as to allow for substantially simultaneous application of multiple layers of joint compound to a given joint. The joint compound comprises about 45% by weight of calcium sulfate, about 35% by weight of a room temperature evaporable alcohol, about 10% by weight of polyvinyl alcohol, about 5% by weight of polyvinyl acetate, about 3% by weight talc and about 2% by weight mica.

The present invention also provides an apparatus for taping joints between pieces of wallboard, comprising a taping head, slidingly contactable with a wall, for substantially simultaneously applying a first layer of a joint compound to a joint between pieces of wallboard, embedding a wallboard tape in the first layer of the joint compound and overcoating the embedded wallboard tape with at least one additional layer of the joint compound; a handle, connected to the taping head, for supporting the taping head, the handle being manually graspable by an operator, the handle having a fluid conduit formed therein for passing joint compound to the taping head; a tape supply mounted on the handle for supplying wallboard tape to the taping head; a backpack, wearable by the operator, for supporting a supply of the joint compound and for producing a pressurized stream of the joint compound; a flexible connection for fluidically interconnecting the backpack and the fluid conduit to pass the pressurized stream of the joint compound from the backpack to the fluid conduit.

In a preferred embodiment of the apparatus according to the present invention, the taping head comprises a first support plate, attached to the handle; a guide means, attached to the first support plate, for guiding a wallboard tape of predetermined width being applied to a joint; first orifice means, attached to the first support plate, for feeding a first layer of joint compound to a surface of the wallboard tape intermediate the joint and the wallboard tape, the first orifice means fluidically connected to the fluid conduit means; a second support plate, releasably attachable to the handle; biasing means, attached to the second support plate, for yieldably urging the wallboard tape and, hence, the first layer of joint compound, into contact with the wall, when the taping head is in contact with the wall, to embed the wallboard tape in the first layer of joint compound; second orifice means, formed in the second support plate proximate the first support plate, for overcoating the wallboard tape with a second layer of the joint compound, the second orifice means having a width greater than the wallboard tape, the second orifice means being centered, widthwise, with respect to the guide means; first passage means, formed in the second support plate, for fluidically connecting the second orifice means and the fluid conduit means; first gate means, pivotally connected to the second support plate for pivotal movement between a first position and a second position, the first gate means preventing flow of joint compound through the second orifice means when in the first position and allowing flow of joint compound through the second orifice means when in the second position; second biasing means for yieldably urging the first gate means to the first position; third orifice means, formed in the second support plate remote from the first support plate, for overcoating the second layer of the joint compound with a third layer of the joint compound, the third orifice means having a width greater than the second orifice means, the third orifice means being centered, widthwise, with respect to the guide means; second passage means, formed in the second support plate, for fluidically connecting the third orifice means and the fluid conduit means; second gate means, pivotally connected to the second support plate for pivotal movement between a first position and a second position, the second gate means preventing flow of joint compound through the third orifice means when in the first position and allowing flow of joint compound through the third orifice means when in the second position; third biasing means for yieldably urging the second gate means to the first position; first resilient wiper means, mounted on the second support plate intermediate the second orifice means and the third orifice means, for spreading and smoothing the second layer of the joint compound; second resilient wiper blade means, mounted on the second support plate on the opposite side of the third orifice means from the first resilient wiper blade means, for spreading and smoothing the third layer of the joint compound.

In a particularly preferred embodiment, the taping head further comprises roller means, mounted on the second support plate, for imprinting a surface pattern on the third layer of the joint compound, wherein the imprinted surface pattern preferably matches a surface pattern on the wallboard.

THE PRESENT INVENTION

An important feature of the invention is that it provides a superior professional finish to wallboard joints by workers with low experience levels in significantly reduced time. It does this by several related criteria:

1) Close control of the application or administering the proper quantities of joint compound in a three-layer technique as disclosed in my above-identified applications by a microprocessor.

2) Correlating the feed of joint compound to the rate of embedment or laying down of the joint tape and the speed of the human operator.

3) Sensing departures from a predetermined depth of fill and adjusts the "crown" automatically.

In a preferred embodiment this criteria is carried out by flexible floats or blades which have their curvature automatically adjusted to accommodate departures from a predetermined depth or level of the tape. In one embodiment, smoothing rollers are displaceable by variations from a predetermined depth or level of fill and such departures are used to physically adjust the curvature and hence "crown" of the joint compound or "mud". While this could be done mechanically, in a preferred embodiment, motion of the rollers is sensed and transduced to analog signals which, in turn, are digitized by analog-to-digital converters and the digital signals supplied to a microprocessor which tracks these signals. Departures from a predetermined norm are used to produce control signals to adjust the curvature of the flexible floats which, preferably have a parabolic curvature, and which floats smooth one or more joint compound layers which are applied over the tape. In a preferred embodiment disclosed and claimed in my above-identified applications, first and second joint compound layers are applied over the tape and its underlying initial joint compound layer.

The joint compound is smoothed by a related adjustable flexible float means, with the curvature of each float being adjusted by signals from the microprocessor to electric motors mounted in the device.

The adjustable flexible floats or blades are made from any preferably long-wearing material and, in one preferred embodiment, they are hollow brass members sealed at their ends and when a pair (or more) are used, the downstream flexible floats are longer than the upstream flexible floats. The adjustable flexible floats have a generally parabolic curvature which is adjusted to produce the desired "crown" in the joint compound or mud that is in the first and second layers overlying the tape and initial layer.

A preferred (but not exclusive) way of adjusting the flexible floats is by pulling on the lateral end of the blade or floats while pressing in the middle. This can be accomplished by members coupled to the float at the lateral ends which are driven by a motor in one direction while adjacent internal points coupled to the motor are driven in an opposite direction by worm gears, for example. In a preferred embodiment, a natural curve flexible float has an arc which sub-tends the maximum "crown" in the joint compound. However, one would not go beyond the invention by adjusting the "crown" beyond the natural curvature.

In a preferred embodiment, the handle has a plurality of switches as follows:

A first switch in the "on" position allows voltage to be supplied to a pump motor control center located in the pump motor housing. One Hundred Ten volt AC is loaded to the out-going pump current lines by a relay controlled by the microprocessor. One pump receives enough voltage to turn the impeller of the pump for a predetermined period of time to cause static pressure throughout the fluid flow pass to a nominal pressure of about 16lb/psi. A second pump switch is a "kill switch"

which, when the tool is in the auto function, acts as a panic switch for the operator to use in case of an emergency so that operation of this switch will kill all pump voltage as well as current loading to the computer and effectively renders the tool inoperative. The third switch is a blade or flow control for the up function. The up function is the function that affords the most ability to leave crown compound intact on the wall. This control actuates the played blade motors which adjusts the curvature of the flexible blades or floats. The blades are adjusted to cause an adjustment in the bow-like or curvature configuration which is assumed by the blades allowing more or less compound to be passed under the center part of the blade than at the edges. The up function is limited by the microprocessor to allow it to fill the inverse of the blade control sensors. This means that either the inboard or the outboard control sensors (there are four per blade) are reading by virtue of their positions either a low place in the wallboard (sheet rock) that needs to be filled or a gap or hole in the area of the joint itself. In a preferred embodiment, there are a pair of blades, a long blade (having an exemplary dimension of about 10") and a short blade (having an exemplary dimension of about 7"). When the short blade is being drawn along the wall will read by virtue of its sensor position that the maximum angle of assumption needed to fill the deficit and that that angle will be assumed by the trailing longer blade. The up function is automatic and need not be operated manually except in cases of severe filling requirements which will not be met by the sensor position.

A further switch (blade control down) is the opposite of a blade up position and causes the blade to assume a convex position rather than a concave position. This causes less compound to be left in the sweep or crown area rather than more.

A fifth switch allows the advancement of the tape of the end of the taping head. Since all of the heads are of different length, the microprocessor must take into consideration which taping head is on the handle. Since each head has its own numerical code, the microprocessor is programmed to actuate the tape advance motor in a precise time slot clock segmenting to allow pre-programmed current loading to occur long enough to advance the tape in each head. In the case of corner metal heads, the microprocessor disconnects current loading and the switch is rendered inoperative.

A sixth switch is a tape cut switch. This switch controls a direct current motor which operates a cutting blade which cuts transversely the tape and the switch is a center-off position knob that can be manually actuated by the operator to control the tape cutting mechanism in a left-to-right or right-to-left configuration. This means that the tape is cut with one sweep of the cutter without having to return to a home position after each cut. The microprocessor automatically senses the position of the cutter head and reverses the polarity of the tape cutting motor after each pass so that the operator does not have to manually throw the switch to reverse polarity of the motor.

A seventh switch is the auto function switch. This switch when turned on at the beginning of the operating automatically initializes the microprocessor and activates the sensors as well as the tape counting mechanism and the tape compound status (empty or full) mechanism. In the typical operation, the auto function accesses all of the sensor devices and counting devices as well as the time clock control functions that operate the automatic tape cutting mechanism and tape advance. This switch automatically puts the tool in a fully computer control status so that the operator has no control over any of the functions of the tool except emergency override. Thus, the tape will be automatically cut when the operator brings the tool to a complete stop, then the tape is advanced to the end of the head to begin the next sweep. The also means that the wallboard will be sampled ninety times ever one-tenth of a second for fill requirements as the operator pulls the tool along the joint. The auto function also controls the stack RPM of the pump motors, line control of pump pressure at the forward bias GATES. This is accomplished by means of measuring the speed with which the tape is being dispensed and the speed with which the tape control wheels are turning. On the radial axis of the tape confinement unit, an optical isolator samples the magnetic core sweep that is encoded on the axis shaft.

Finally, a final switch, an eighth switch, allows the operator to override the automatic control features This allows the operator to manually cut the tape by means of the tape cut switch as well as to manually advance the tape by using the manual advance switch.

Whenever the auto function switches are in the "off" position, the operator of the tool is able to shift the function of the device into a third autofunction state. This third states affords the operator the ability to speed the functioning of the auto system up by three times. This is done by elimination of sensors in the reading loop. For instance, in the flat finishing head there is no need to adjust the curvature of the floats and it is possible to eliminate two out of four sensors per blade allowing the computer to assume the overall general view of the level of compound required per any given situation. This affords the opportunity for an experienced finisher to gain great rapidity in both the operating of the tape cutting mechanism as well as the tape advance mechanism. Since the microprocessor is controlling the auto tape and auto cut in this function, stop time is cut in half with regards to the length of the time that it take the microprocessor to determine that the tool is stopped and that the tape must be cut in advance to begin the next sweep. The pump sequencing timer is increased incrementally, double in terms of value so that the pump discharge is increased approximately one-quarter over the periodic functioning of the static flow indicator so that the operator will be able to move approximately twice as fast when beginning and ending joint sweeps. By virtue of precise computer control over the application of joint compound to the joints, waste is reduced. Moreover, precise data can be retrieved as to the amount of joints finished in a given period of time.

DETAILED DESCRIPTION OF THE INVENTION

Figure 1A:
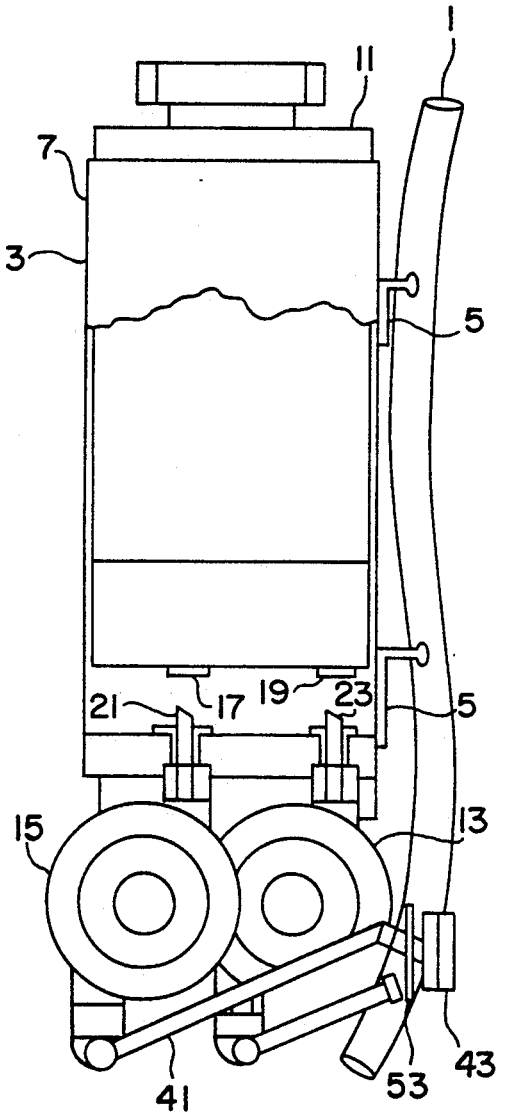
FIG. 1A is a partially cutaway view of the right hand side of the backpack unit according to the present invention.
Figure 1B:
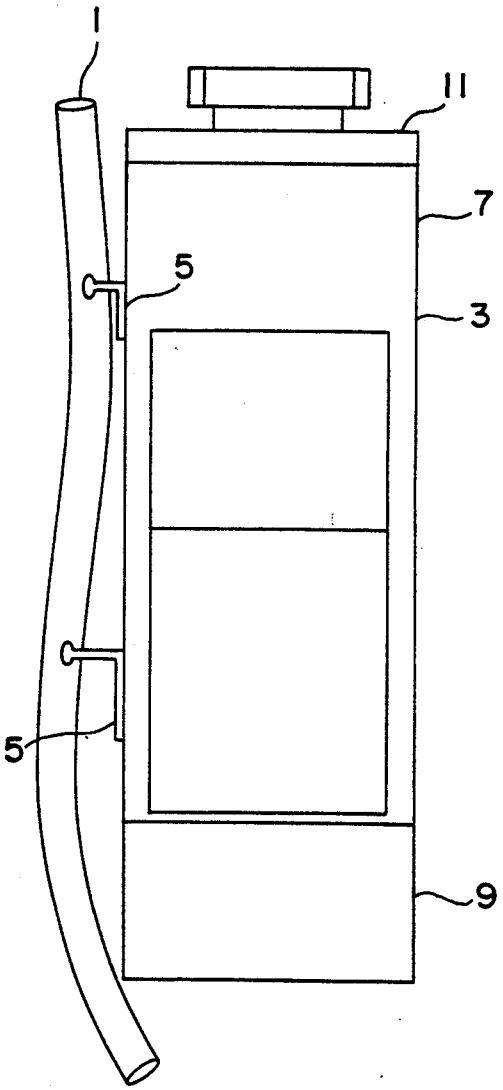
FIG. 1B is a left hand view of the backpack unit according to the present invention.

Turning now to the drawing figures, FIGS. 1A and 1B (a right hand view and a left hand view, respectively) illustrate the backpack portion of the present invention. In particular, the backpack comprises a support frame 1 which is adapted to be fitted with suitable webbing (not shown) so as to allow the backpack to be worn on the back of an operator. A container support 3 is attached to the support frame by brackets 5 which may be screwed to or welded to support frame 1 and container support 3. Container support 3 comprises an upper section 7 in the form of a box open at its top which is receivable of a unit container 11 of joint compound. The container support also comprises a lower section 9 which contains pumps 13 and 15 and related equipment, as will be described hereinafter.

The unit container 11 is fitted with a pair of grommets 17 and 19 which define puncturable portions of the bottom wall of the container 11. When the container 11 is placed within the upper section 7, a pair of upstanding pipe portions 21 and 23, which are cut at an angle so as to form a "sharpened" edge, are aligned with the grommets 17 and 19, respectively, and insertion of the container 11 fully into the upper section 7 causes these upstanding pipe sections 21 and 23 to pierce the wall of the container and provide fluid communication between the container and the pumps as will be described hereinafter.

Figure 2:
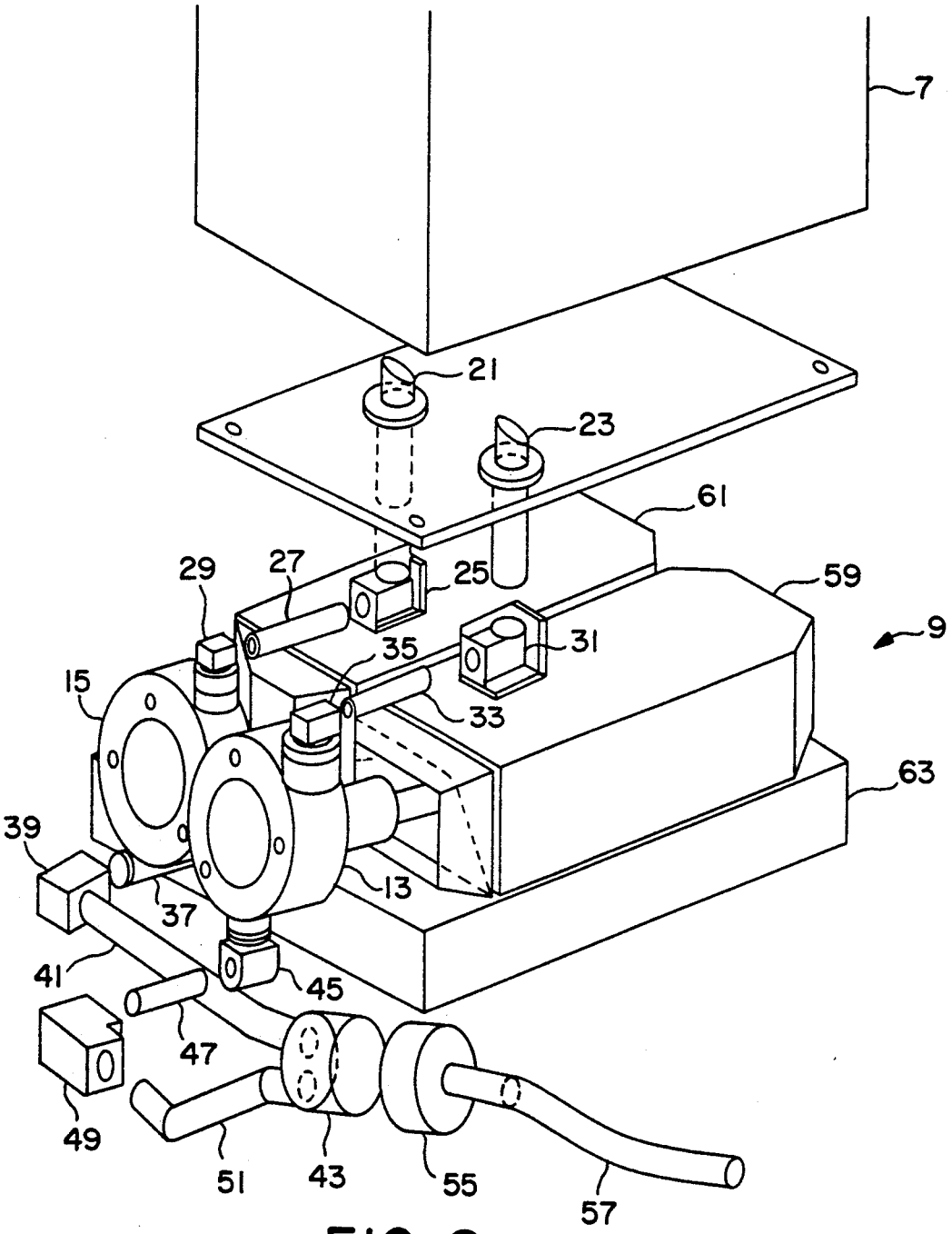
FIG. 2 is a partially exploded view of the backpack unit showing the pumping mechanism.

As may best be seen in FIG. 2, pipe section 21 is connected through elbow 25 and pipe 27 to the inlet 29 of pump 15. Likewise, pipe 23 is connected through elbow 31 and pipe 33 to the inlet 35 of pump 13. In turn, the outlet 37 of pump 15 is connected via elbow 39 and pipe 41 to outlet fitting 43. Likewise, the outlet 45 of pump 13 is connected via pipe 47, elbow 49 and pipe 51 to the outlet fitting 43. The outlet fitting 43 and/or the pipes 41 and 51 may be supported by a bracket 53 mounted on the support frame 1. The outlet fitting 43 is detachably connectable to an inlet fitting 55 of flexible hose 57.

Pumps 13 and 15, which are preferably positive displacement pumps, and most preferably rotary flexible impeller (vane) pumps, are driven by motors 59 and 61, respectively. Motors 59 and 61 are preferably electric motors driven by 120V electrical supply. The electrical motors 59 and 61 may be supplied with power by a flexible electrical cable connected to a suitable source of power.

Figure 4:
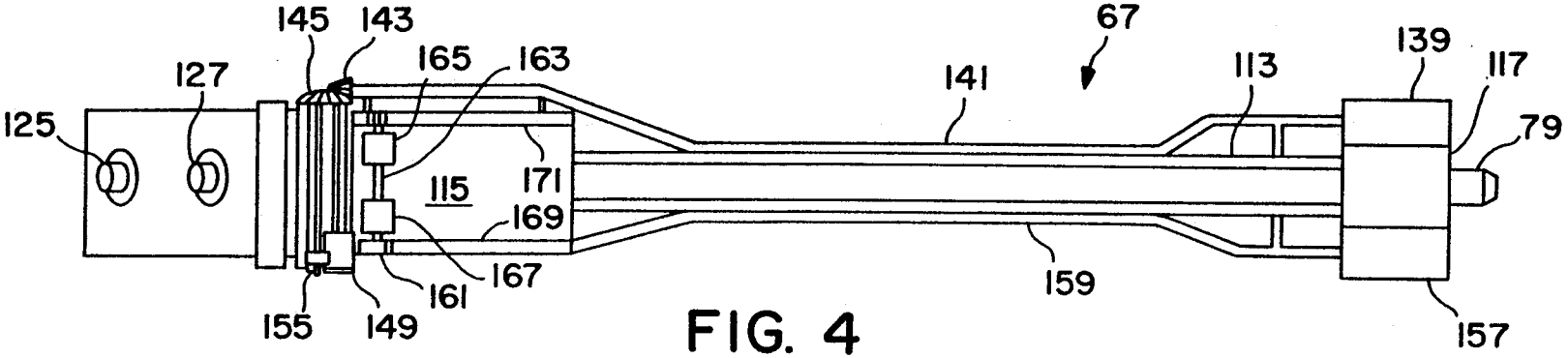
FIG. 4 illustrates another section of the handle according to the present invention.
Figure 3:
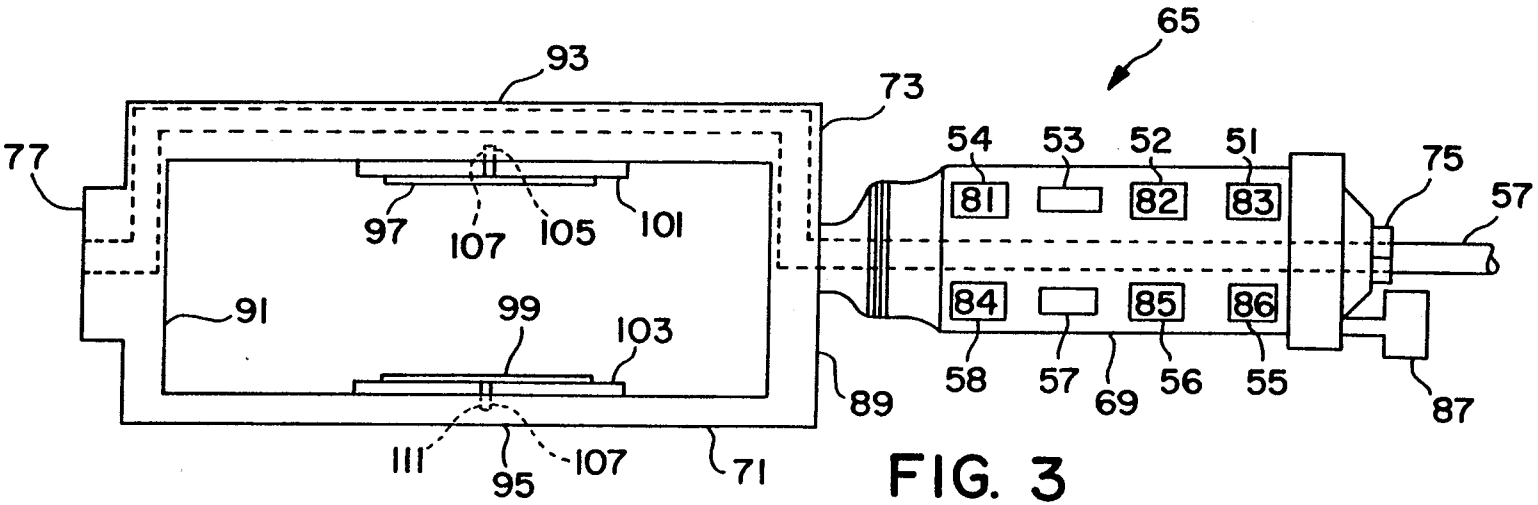
FIG. 3 illustrates a section of the handle according to the present invention.

Joint compound which is pumped from unit container 11, via pumps 13 and 15, to flexible hose 57 is passed to the handle assembly. The handle assembly comprises a control section 65 (as shown in FIG. 3) and a delivery section 67 (as shown in FIG. 4).

The control section 65 comprises a handgrip 69 and a tape supply element 71. A fluid passageway 73 (as shown in dotted lines in FIG. 3) passes through the control section 65 from a socket 75, where flexible hose 57 is fluidically connected to the fluid passage 73, to a socket 77 wherein a plug 79 of the delivery section 67 may be received so as to fluidically connect with the delivery section 67. The handgrip 69 is fitted with switches (in the form of buttons 81–86) for operation of the various functions of the apparatus, as will be disclosed hereinafter. The handgrip 69 is also fitted with a socket 87 for electrical connection of the switches to the various electrical elements in the backpack unit. Additionally, the handgrip 69 is also fitted with an additional socket (not shown) for connection (via a cable connection) to the various electrical devices in the delivery section 67.

Figure 5:
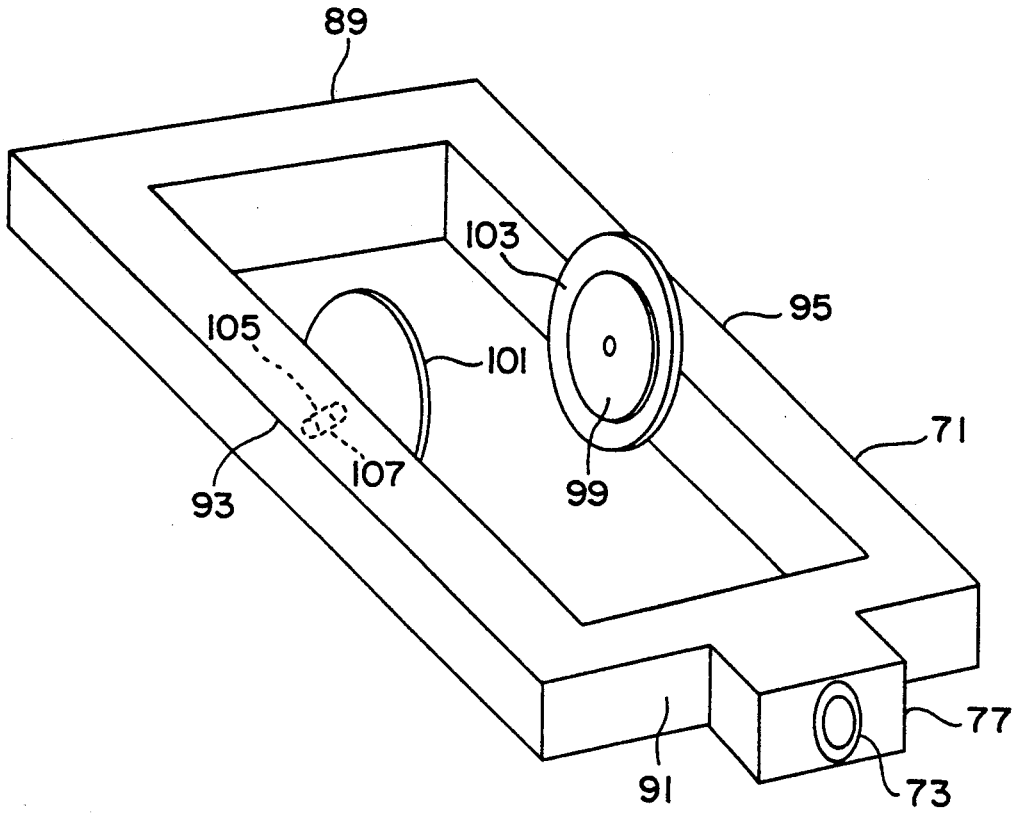
FIG. 5 is a perspective view of a portion of the handle section illustrated in FIG. 3.

The tape supply element 71 is shaped substantially as a hollow rectangle (as best seen in FIG. 5) and comprises first and second cross members, 89 and 91, and first and second connecting members 93 and 95. A first disc 97 is rotatably mounted on connecting member 93. A second disc 99 is rotatably mounted on connecting member 95. The mounting of discs 97 and 99 is such that the discs are rotatably mounted substantially coaxially. Disc 97 is provided with a radially extending flange 101 and disc 99 is provided with a radially extending flange 103. At least one of the discs 97 and 99 is moveable axially with respect to the other disc by being supported for rotation on a pin 105 or 107, respectively, received within a corresponding bore 109 or 111 formed in cross member 93 or 95. A spring (not shown) may be fitted in bore 109 and/or 111 so as to yieldably urge at least one of discs 97 and 99 axially toward the other disc. The discs are of such a diameter as to be received within the core of a roll of wallboard tape, whereby a roll of wallboard tape may be supported on the discs for rotation so as to supply tape through the delivery section 67 of the handle.

Figure 7:
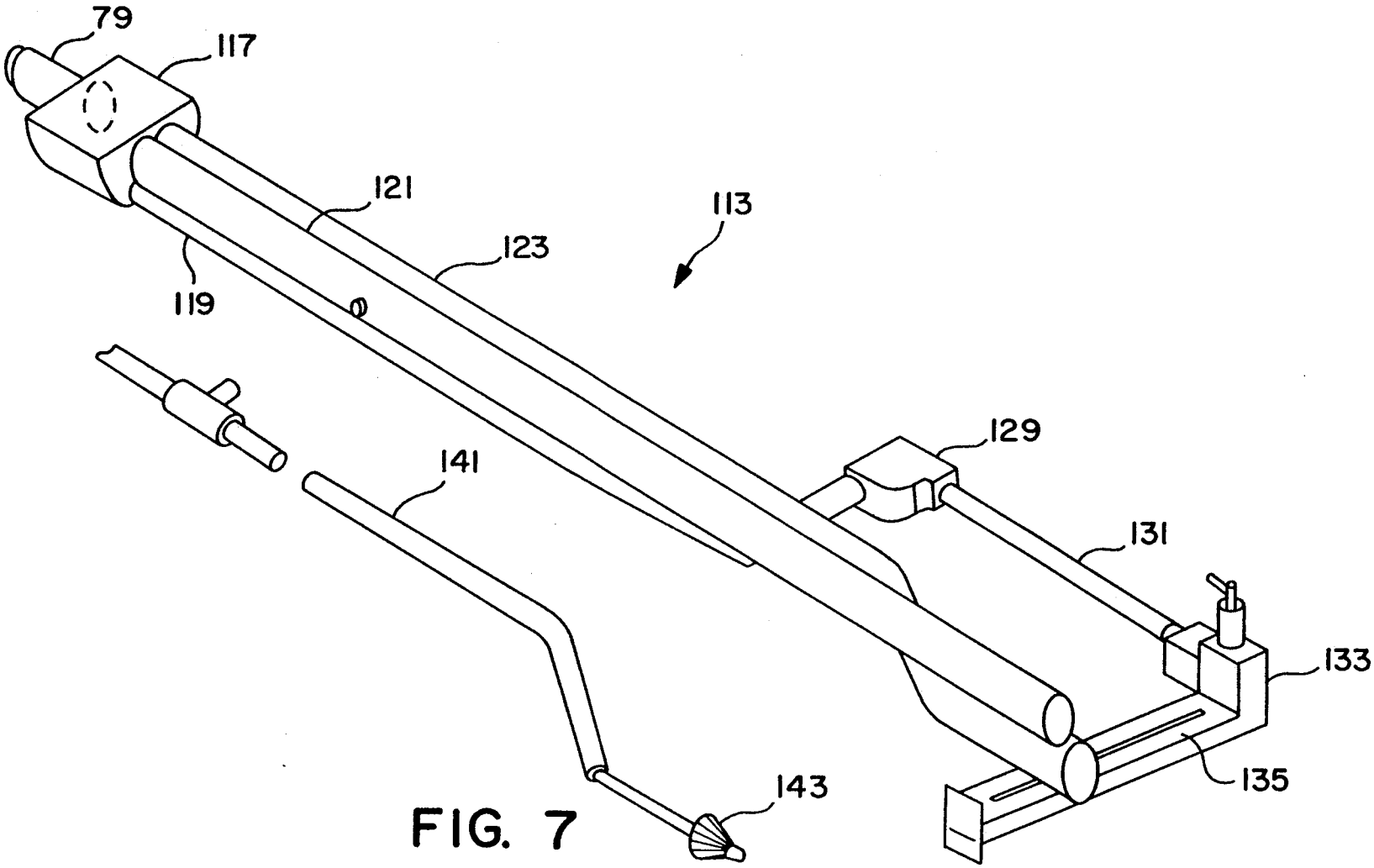
FIG. 7 is a partially exploded view of certain elements of the handle section illustrated in FIG. 4.

The delivery section 67 substantially comprises a fluid conduit assembly 113 and a support plate 115. The fluid conduit assembly, as best seen in FIG. 7, comprises the plug 79 which is fluidically connected to a chamber 117 which in turn is connected to three fluid supply pipes 119, 121 and 123. Pipe 121 is fluidically connected to supply nozzle 125 and pipe 123 is fluidically connected to supply nozzle 127. Pipe 119 is fluidically connected via elbow 129, pipe 131 and valve 133 to tape supply nozzle 135, which when assembled is disposed in region 137 of the support plate 115.

A first stepping motor 139 is mounted on chamber 117 and connected via flexible drive cable 141 to a first bevel gear 143. First bevel gear 143 mates with a second bevel gear 145 which is mounted for rotation with a first shaft 147, shaft 147 having a screw thread formed on the outer periphery thereof. A slider 149 is slidably mounted on rails 151 and 153 with a knife edge (not shown) depending in the gap between rails 151 and 153. Connection member 155 is connected to slider 149 and is fitted with a screw threaded bore corresponding to the screw thread formed on the outer periphery of the first shaft 147, whereby rotation of the first shaft will cause movement of the slider 149 along rails 151 and 153, thereby drawing the knife edge across plate 115. Reversal of the rotation of the first shaft 147 by reversal of the rotation of the first stepping motor 139 will drive the slider, and hence the knife edge, back across plate 115. By alternating the direction of rotation of first stepping motor 139, the knife edge may be drawn back and forth across plate 115 as needed.

A second stepping motor 157 is also mounted on chamber 117 and is connected via flexible drive cable 159 to gear box 161. Gear box 161, in turn, contains gears to drive second shaft 163 upon which friction rollers 165, 167 are mounted for rotation therewith. Plate 115 is fitted with guide rails 169 and 171 so as to guide wallboard tape beneath rollers 165 and 167, beneath rails 151 and 153 as well as shaft 147 and over tape supply nozzle 135.

In operation, a tape passing between guide rails 169 and 171 on plate 115 may be advanced a predetermined amount by actuation of stepping motor 157 so as to cause a predetermined rotation of shaft 163 and the friction rollers 165 and 167 mounted thereon. Likewise, the tape may be cut by actuation of the stepping motor 139 and the concomitant rotation of shaft 147 causing slider 149 (which is fitted with a knife edge) to slide across the width of the tape on plate 115. In this regard, for example, switch 81 on handgrip 69 can actuate stepping motor 157 so as to cause the tape to advance in a predetermined amount. Likewise, switch 84 can be connected to stepping motor 139 so as to cause movement of slider 149 across the tape. It should be noted, however, that switch 84 alternatively changes the polarity of electrical current fed to stepping motor 139 so as to alternately draw the slider across and then back across the plate 115. As the tape passes over tape supply nozzle 135 joint compound is applied to the lower face 173 of the tape 175.

Figure 8:
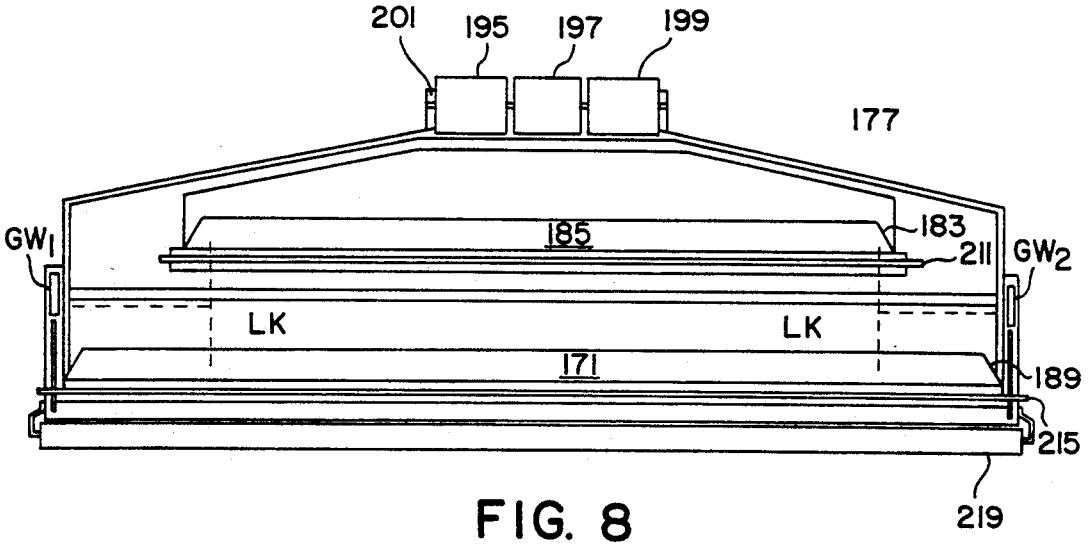
FIG. 8 is a bottom view of the taping head unit.
Figure 9:
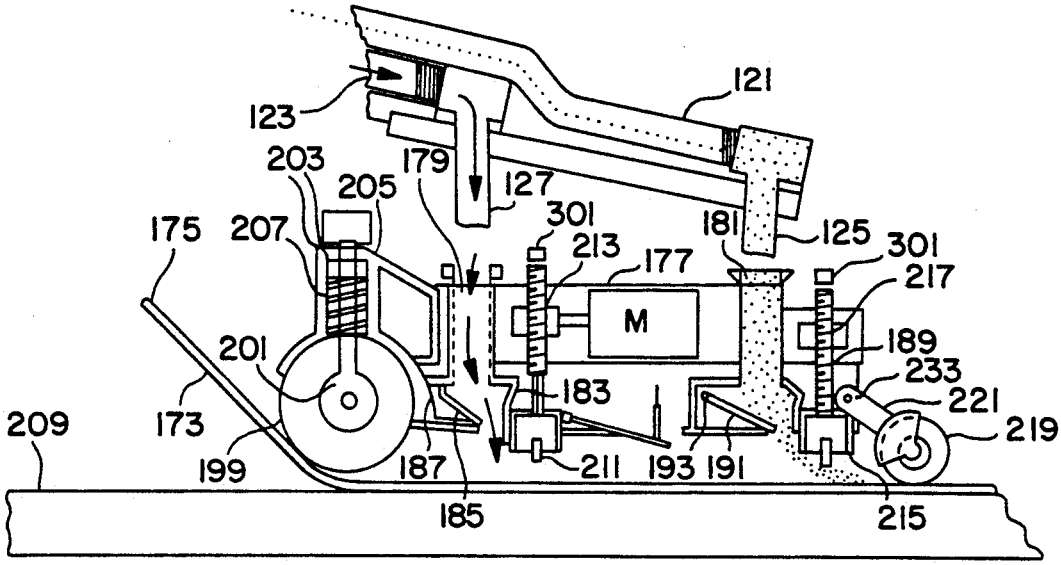
FIG. 9 is a partially cutaway view of the taping head unit.

Turning now to FIGS. 8 and 9, a second plate 177 is releasably attachable to the delivery section 67 of the handle. In this regard, as may best be seen in FIG. 9, supply nozzles 125 and 127 may be respectively received in passages 179 and 181 in a snap-fit or force-fit manner. Passage 179 communicates with an orifice 183 formed in plate 177. The orifice 183 is fitted with a gate 185 which is pivotally mounted on plate 177 so as to be moveable from a first position in which fluid passage through the orifice is prevented to a second position (as shown in FIG. 9) wherein fluid passage through orifice 183 s permitted. The gate may be biased, by a torsion spring 187, so as to be yieldably urged to the first position. A linkage LK for laterally located gauge wheels GWl opens gate 185 when the unit is pressed against a wall.

In a similar manner, passage 181 communicates with an orifice 189 formed in plate 177. Orifice 189 is also fitted with a gate 191 pivotally connected to plate 177 so as to be moveable from a first position in which fluid flow through the orifice is prevented and a second position in which fluid flow through the orifice is permitted. Gate 191 may also be biased, as by torsion spring 193, so as to yieldably urge the gate to the first position and opened by the linkage LK with gate 185.

Rollers 195, 197 and 199 may be supported on a shaft 201 which in turn is journaled in a support member 203 carried in bore 205 formed in the plate 177. A biasing spring 207 yieldably urges the rollers downwardly so as to force the lower side 173 of tape 175 into contact with wallboard 209. A first resilient wiper blade 211 adjustably mounted in the plate 177 as by a screw support 213 smoothes and spreads joint compound delivered through the orifice 183. A second flexible wiper blade 215 adjustably mounted in plate 177 as by screw support 217 moves and spreads the joint compound delivered to the wallboard through orifice 189. A printing roller 219 may be provided with a surface pattern matching the surface pattern of the wallboard 209 so as to aid in disguising the position of the seams formed by the present apparatus. The roller 219 may be supported by support 221 which in turn is pivotally attached to plate 177 and may be biased into contact with the seam surface as by a torsion spring 223.

Figure 10:
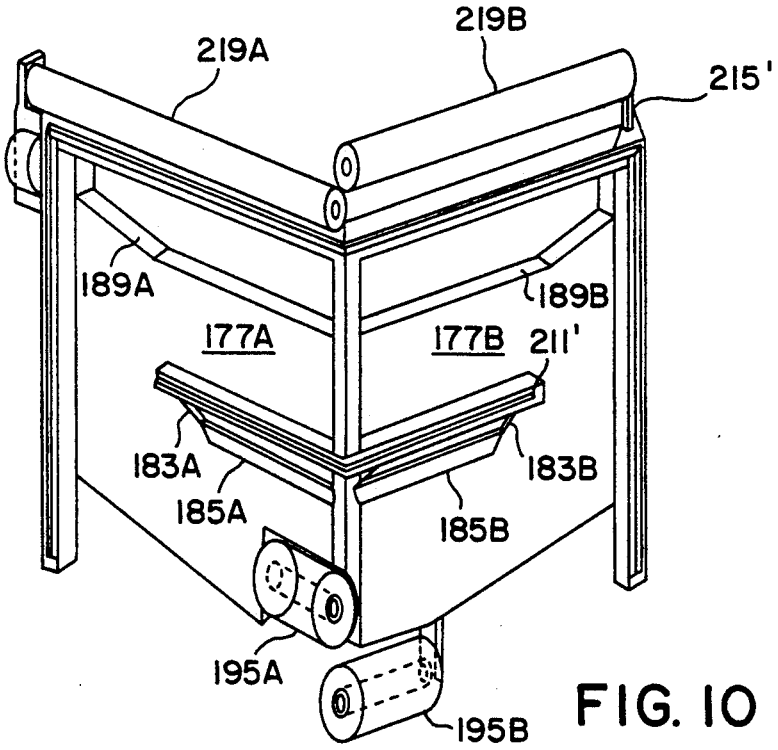
FIG. 10 is a perspective view of the underside of an alternative taping head unit.

As shown in FIG. 10, the second support plate may also be formed in other configurations so as to allow specialized taping operations, e.g., the taping of inside corners. In this regard, the plate is formed in two sections 177A and 177B which are at right angles to one another. A pair of printing rollers 219A and 219B is also provided, each of the rollers being disposed so as to imprint one side of the seam. Likewise, a pair of rollers 195A and 195B are also provided so as to bias the tape into contact with the respective sides of the seam. A pair of orifices 183A and 183B are provided so as to place a first coat of joint compound on the upper surface of the tape and these orifices are controlled in a manner similar to the flat taping head shown in FIGS. 8 and 9 by the provision of gates 185A and 185B. Like wise, a pair of second orifices 189A and 189B are also provided so as to place a second coat of joint compound on the tape. Although not shown in FIG. 10, a pair of gates analogous to gate 191 in the flat taping head may also be provided to control the flow of joint compound through orifice 189A and orifice 189B. A first wiper 211' and a second wiper 215' are also provided so as to spread and smooth the respective coats of joint compound.

In operation, the operator will turn on the apparatus as by the depression of switch 82 which causes power to be supplied to motor 59 which drives pump 13. However, the pressure developed by pump 13 is insufficient by itself to overcome the biasing action of springs 187 and 193 in maintaining gates 185 and 191 in the closed position. However, joint compound will be supplied through tape supply nozzle 135 to the underside of the wallboard tape. Immediately upon turning on the apparatus, the operator will then activate the wallboard tape advance so as to cause the coating of the bottom portion of a predetermined length of wallboard tape which will then be placed into contact with the wallboard 209 by pressure from rollers 195, 197 and 199. The wallboard tape which is so pressed against the wallboard is effectively adhesively adhered to the wallboard and the operator may now move the taping head downwardly (or upwardly) along the wall so as to draw tape from the tape supply wheel (the rollers 165 and 167 permitting such passage of the tape slidingly thereover). With the beginning of motion of the taping head across the wall, the operator may then activate motor 61 driving pump 15 so as to overcome the bias of springs 187 and 198 holding gates 185 and 191 shut. By controlling the operation of pump 15, the operator may control the amount of joint compound being fed to the head so as to suit the particular application conditions being dealt with. When the operator comes to the end of the stroke, the knife edge carried on slider 149 may be activated so as to cut the tape off and allow the operator to finish the end of the tape. This cycle may then be repeated in taping the next seam in the operation.

In the case where the operator is merely patching nail or screw holes in the wallboard, e.g., or in those situations where no tape feed is desired, the valve 133 may be closed so as to prevent the feed of joint compound through tape supply nozzle 135 and joint compound may be fed exclusively through orifice 183 and orifice 189.

In order to effectuate the process and apparatus of the present invention, it is necessary to utilize a fast-drying joint compound so as to allow multiple coats to be disposed one upon the other in a substantially simultaneous manner. In this regard, Applicant has developed a joint compound comprising about 45% by weight of calcium sulfate, about 35% by weight of a room temperature, evaporable alcohol, about 10% by weight of polyvinyl alcohol, about 5% by weight of polyvinyl acetate, about 3% by weight talc, and about 2% by weight mica.

By room temperature evaporable alcohol is meant an alcohol which will readily evaporate under conventional room temperatures in the building trades. Methyl, ethyl and propyl alcohols having been found suitable for this use. Preferably, the alcohol comprises commercially denatured ethyl alcohol.

As previously noted, the present apparatus allows for the taping of joints between pieces of wallboard by the substantially simultaneous steps of (a) applying a first layer of a joint compound to the joint between pieces of wallboard, the first layer of joint compound having a first predetermined width, the first layer of the joint compound being substantially centered, widthwise, on the joint; (b) embedding a wallboard tape in the first layer of the joint compound, the wallboard tape having a width substantially equal to the first predetermined width, the wallboard tape being substantially centered, widthwise, on the joint; and (c) overcoating of the embedded wallboard tape with at least one additional layer of the joint compound, the at least one additional layer of joint compound having a width greater than the first predetermined width, the at least one additional layer of the joint compound being substantially centered, widthwise, on the joint.

Figure 11:
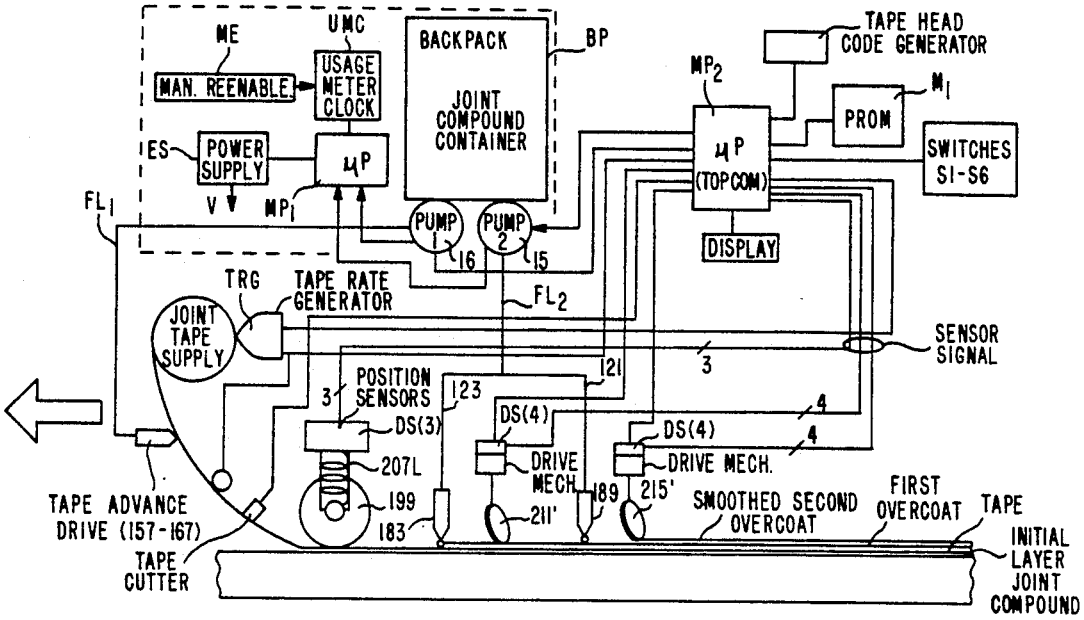
FIG. 11 is a schematic and pictorial block diagram illustrating the sensors and their interrelationship with the microprocessor system.

FIG. 11 is a detailed overall illustration showing the functional interrelationship of the components. The backpack BP, shown in detail in FIGS. 1*a* and 1*b*, includes pumps 15 and 16. The electrical supply ES which could be batteries, but in the preferred embodiment is connected to a 110V AC supply and includes a step-down transformer, AC-to-DC converter, regulator, and the usual safety features (not shown), and supplies operating potentials to the various electrical and electronic components.

For rental purposes, microprocessor MP1 may be used to sense operation of pumps 15 and 16 and in conjunction with a usage meter clock UMC, monitor the overall period of use of the apparatus and at the end of a predetermined period of time, disables the apparatus by disabling the electrical supply ES. Where the machine is part of a rental system, this feature prevents unauthorized use. A manual reenablement ME, such as a key or a replacement of component that is disabled upon elapse of the predetermined time period, is used to reactivate the electrical supply system.

As described earlier, when the system is initially activated (after loading the backpack container with joint compound and the tape supply element 71 with tape), pumps 15 and 16, under control of microprocessor MP2 are energized to pressurize the joint compound fluid lines schematically illustrated in FIG. 11 by lines FL1 and FL2, but described in detail earlier herein. Joint compound is supplied to nozzle 135 and in the manual mode the operator activates the tape advance drive stepping motor 157 and rollers 165 and 167 to advance the tape past nozzle 135 a predetermined amount to thereby coat a predetermined length of tape. This predetermined length is from nozzle 135 to the edge of the head beyond blade 215 (FIG. 8) and in advance of printing roller 219. When the joint compound side of the joint tape is pressed onto the joint, sets of gauge wheels GW1, GW2 operate a linkage LK (shown dotted in FIG. 8) to open gates 195 and 191 to allow joint compound to flow through and be spread by nozzles 183, 189 onto the embedded joint tape by virtue of the operation of pump motor 15. As discussed earlier, the pump motors are controlled by microprocessor MP2.

As shown in FIG. 11, a tape usage or rate generator TRG, which in this embodiment is a conventional optical disk sensing device which converts rotation of the optical disk to an electrical signal corresponding to the rate tape is removed from the tape reel. This signal is supplied to the microprocessor MP2 so that the rate the workman draws the device along a joint to be taped controls via microprocessor MP2 the joint compound and pump motors 15, 16 thereby delivering joint compound to the nozzles 135, 183 and 189 at the precise rate required to assure uniform high quality joints regardless of this skill level of the operator.

As the tape with joint compound is laid down, a bank of spring biased depth sensing rollers 199 smooths out any air bubbles that may be trapped in the joint compound and tape irregularities and at the same time measure or sense the position of depth sensors DS which gauge the depth of the tape and also senses any departures or variations from a predetermined depth, which may be loaded into microprocessor MP2 from a PROM memory element M.

Figure 13A:
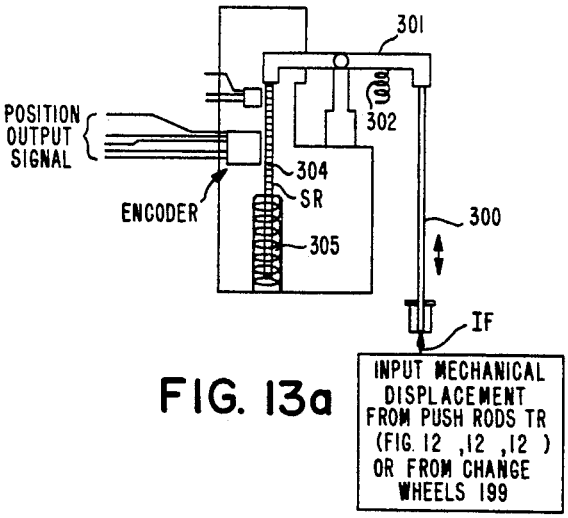
FIGS. 13*a* and 13*b* illustrate a position transducer sensor system used in the invention.
Figure 13B:
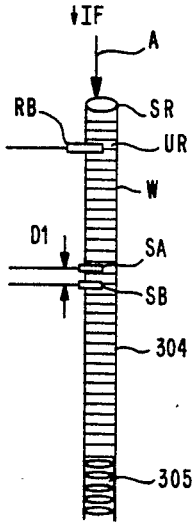

FIGS. 13*a* and 13*b* show one form of position of depth sensor. The position sensor shown in FIG. 13*a* includes a coupling member 300 coupled to the roller wheel 199, such as spring biased linkage 207L (or to the top of the blade control push-pull rods discussed later). Pivotal lever member 301 is biased by spring 302 in engagement with member 300 at one end thereof and the opposite end of lever 301 is engagement with tubular resistance wire carrier tube 304. The lower end of carrier tube 304 is engaged by a spring 305 so as to maintain engagement of the upper end of tube 304 with lever 301. It will be appreciated that lever 301 may be pivotally coupled to the ends of rod 300 and tube 304.

Tube 304, shown enlarged in FIG. 13*b* has winding W with high density windings in the center lower density windings at each end with a linear graduation of the windings between the ends and constitutes a sensor tube or rod SR. A reference brush RB applies a predetermined level VR of voltage to one end of sensor rod SR. (This voltage level is controlled by microprocessor MP2.) A pair of sensor brushes or wipers SA and SB are spaced a small distance D1 apart and the average of the voltages on each sensor brush SA and SB constitutes the position of the sensor rod SR. This voltage is converted to digital by an analog-to-digital converter. Arrow IF indicates a mechanical input signal. It will be appreciated that other forms of position transducers may be used. For example, linear variable differential transformers in which the coils are stationary and a movable core is connected or operably coupled to the device where displacement or movement is to be monitored. A optical coding wheel may likewise be used to translate movement of a member to electrical signals for processing and control purposes.

Figure 6:
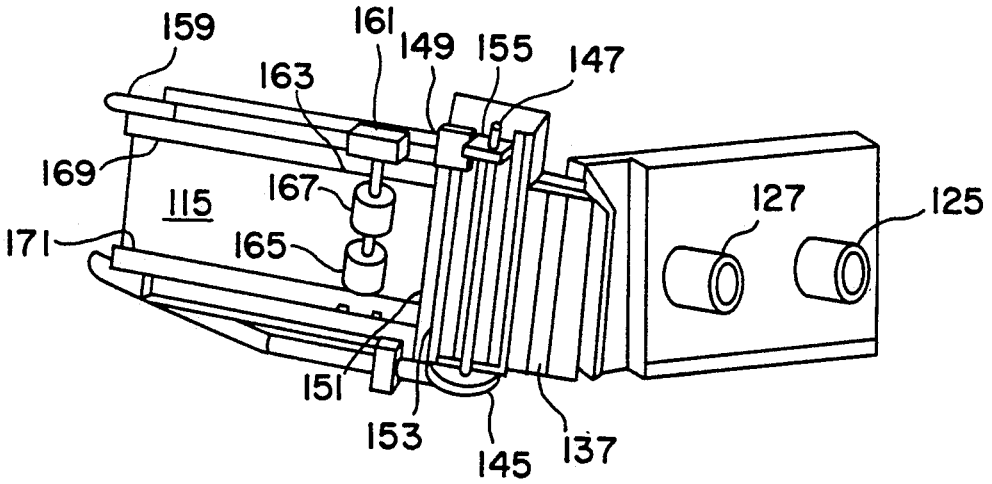
FIG. 6 is a perspective view of a portion of the handle section illustrated in FIG. 4.
Figure 12A:
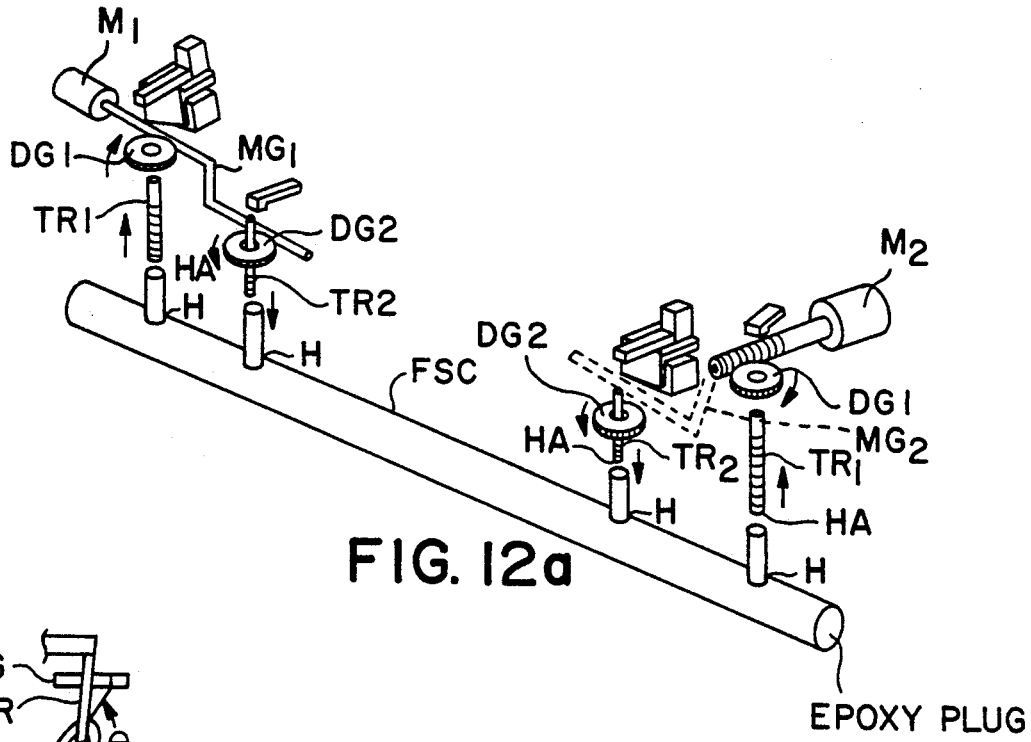
FIGS. 12*b* and 12*c* illustrate the blade adjust system.
Figure 12C:
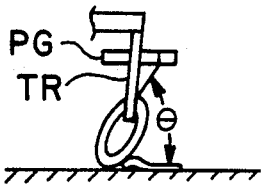
Figure 12B:
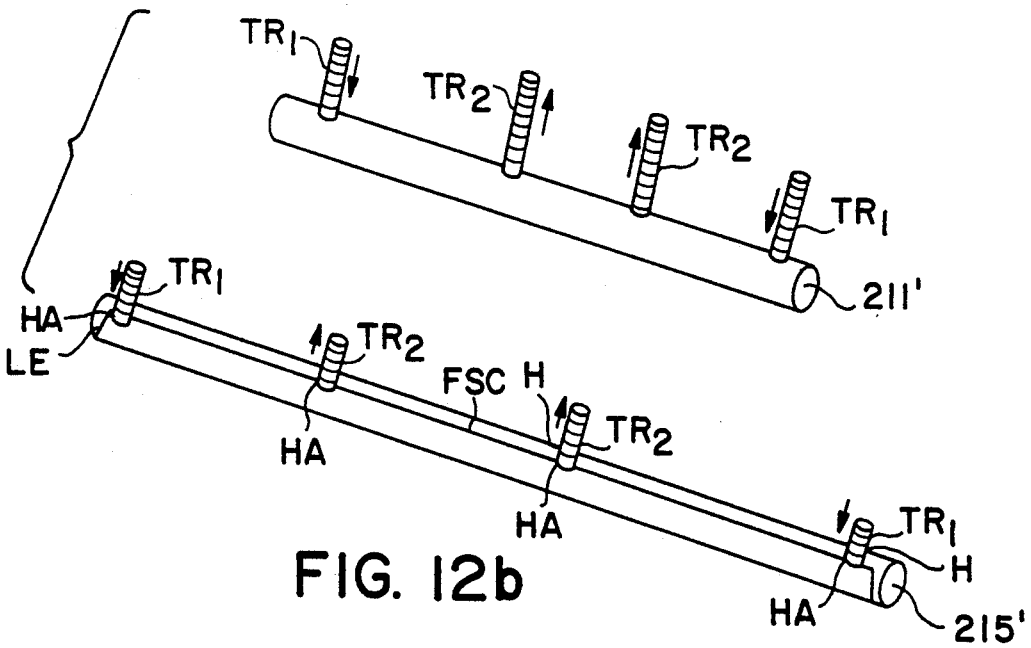

As disclosed in my above application, various type of taping heads may be used, they may have straight blades or floats, heads for corners, etc., and flexible blades and the amount of tape initial advancement can vary for each head. When a head such as shown in FIGS. 8 and 9 or FIG. 10 or a flexible bladed head as shown in FIGS. 12*a*, 12*b* and 12*c* is fitted to the assembly of FIG. 6, a signal from tape head code generator THCG is supplied to microprocessor MP2 and this data conditions the apparatus for operation with the fitted head. Tape head code generator may be a manually activated thumb-wheel switch mounted on grip 69 or a set of code pins (not shown) on actuating code switches on the handle section shown in FIG. 4. This would be preferred as it eliminates a function that would be performed by the operator.

Joint compound dispensing and spreading nozzles 183 and 189 are followed by flexible adjustable smoothing floats or blades 211' AND 215', respectively, shown in FIG. 11. The upstream float or blade 211' is shorter than the downstream blade 215' and for conventional joints exemplary float or blade 215' and the conventional joints exemplary dimensions are about 7 and 10 inches, respectively. Both blades have a slight initial parabolic curvature so that without any controlled change in their shapes, a natural "crown" is imparted to the joint compound layers applied by spreader nozzles 183 and 189, respectively, so that when the joint compound of these layers dry and cure, they shrink to a flat surface. However, undulations, irregularities and the like (which well experienced workmen would attend to, perhaps the next day) could cause such imperfections to appear in the finished joint. In many cases, adjacent wallboards may be at slightly different levels. These are sensed and appropriate shape changes made to the blades.

The adjustable flexible floats or blades 211' and 215' may be made from any long wearing material. They could be made from metal, such as brass, stainless steel, etc., plastics such as Teflon ®, nylon, hard rubbers, etc. In a preferred embodiment, a hollow brass tube having an oval cross-sectional shape (FIG. 13*c*) and an initial parabolic curvature along the length thereof is used and being mounted to achieve a predetermined angle of deflection ($\theta$) (FIG. 13*c*). A "crown" is produced in the joint compound layers which produces a feathered edge with the parabolic crown drying or curing to a smooth flat surface.

Adjustments in the shape and/or curvature is achieved by one or more motors which are controlled by microprocessor MP2. Each of the floats or blades is provided with one or more motors (they could be solenoids). In a preferred (but not exclusive) embodiment, there two motors M1, M2 per float or blade 211' and 215'. Each motor drives a shaft MG1 and MG2, which have opposite drive gears DG1, DG2 so that when motor drive shaft MG rotates gear wheels MG1 and MG2, they rotate in opposite directions. Motor gear wheels MG1 and MG2 are threadably engaged with threaded push rods TR1 and TR2, respectively so that when the drive motor rotates in one direction, the threads push rods TR1 and TR2 are driven in opposing rotary directions.

The lower ends of all of the threaded rods pass through holes H in the upper edges of oval floats or blades. A flexible spring coupling rod FSC passes through holes HA in the lower ends of threaded push rods and have their lateral ends LE bent to thereby flexibly retain the floats or blades on the lower ends of the push rods.

Figure 14:
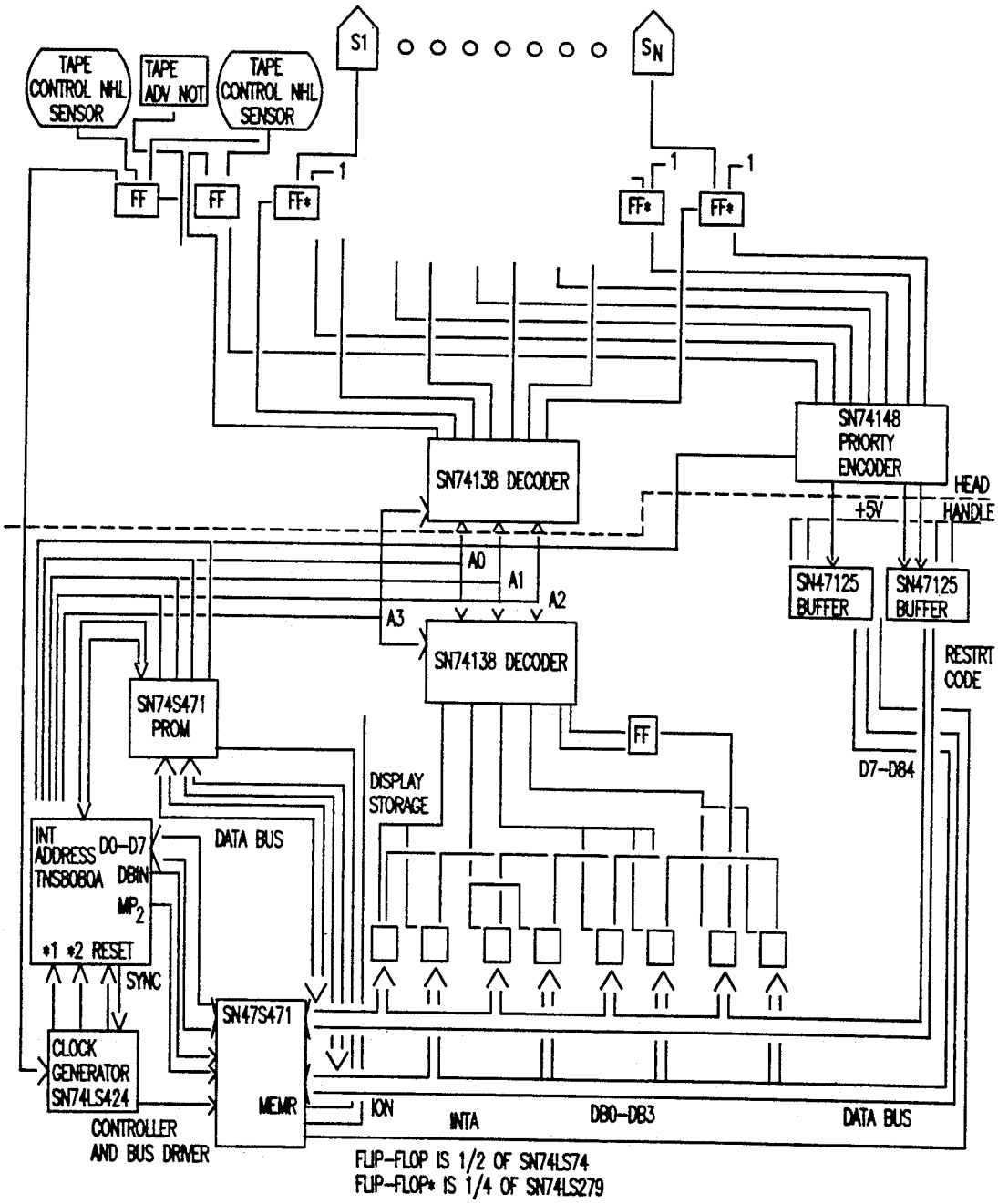
FIGS. 14 and 15 are further block diagrams illustrating the details of the electrical circuitry involved in the taping head and handle.
Figure 15:
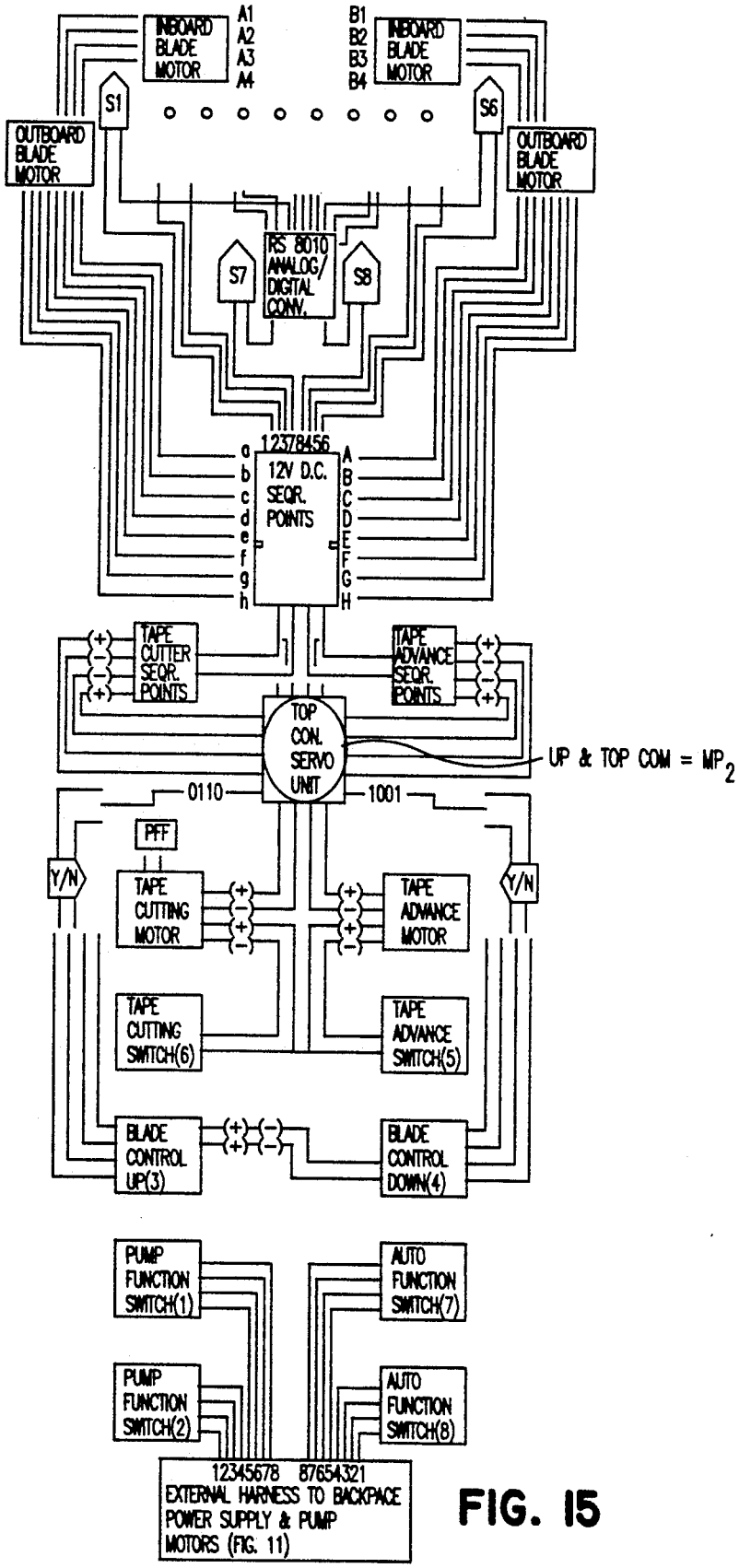
Figure 16:
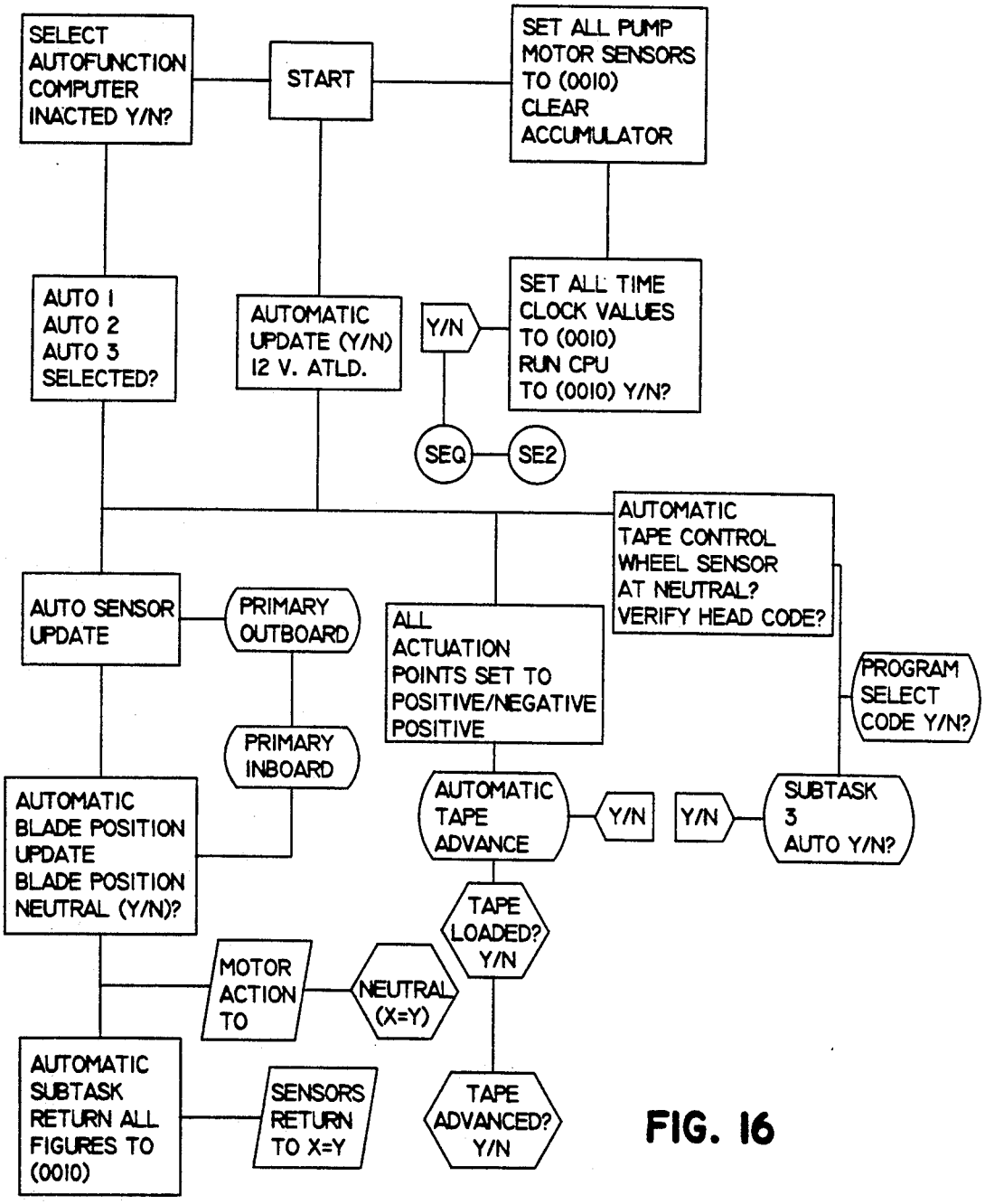
FIGS. 16–22 are flow charts illustrating the software operations of the invention and are considered with FIGS. 14 and 15.
Figure 17:
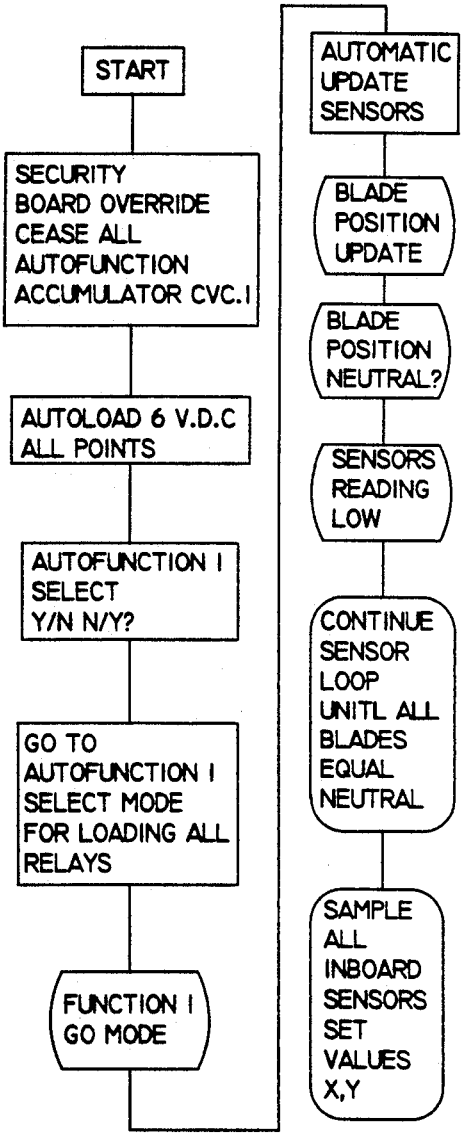

As indicated in FIG. 14a, the upper ends of each push rod is provided with a position displacement sensor, each of which produces independent electrical signals of those positions. In this embodiment there are eleven sensors, eight on the push rod blades and three on the gauging wheels 199. The sensors on the push rods are scanned by microprocessor MP2 and provide signals to microprocessor MP2 indicative of the shape of the floats or blades 211' and 215' by virtue of the positions of the ends of the push rods. Any change in shape is controlled basically by the control of the four motors driving the push rods up or down and the motors are controlled by microprocessor MP2 after it processes the signals from sensors on the bank of rollers 199.

The floats or blades can be adjusted from a concave configuration to a convex configuration relative to the joint compound which has been deposited from spreader nozzles 183 and 189. When one board surface is higher than the other, the shape adjustment can be on one end whereby microprocessor MP2 drives the blade to adjust motors on one side of the blade to accommodate this problem.

Referring now to the block diagrams of FIGS. 14*a* and 14*b*, flow charts (FIGS. 16 to 22 inclusive, illustrating software operations of the present invention, start is initiated when the tool is placed against the wall and one of the auto function switches is actuated. At start, three simultaneous functions occur, based on which autofunction program is selected, the blade control motors, the head sensors, the pump control motors, and the tape counter values are all set based on the code signals set by the auto function switch selected. The start function is reflected in the flow diagram shown in FIG. 16. As part of the simultaneous start function, the security board override system is sampled to determine if the tool is the past its rental period. If the tool is past its rental period then the jump routine will occur that will send an interrupt command to all function routine and in order to reestablish service, the time clock generator has to be reset. At the start function, all motor relays such as head motors, etc. are loaded with a direct current voltage to start all tasks.

In autofunction 1 select 4, the sampling function occurs. The accumulator cycle is sampled to determine the beginning positions of the blades as well as the pump motor and tape counter. The fourth sampling position (the first priority) averages the head sensors to determine the general position of the blades in relationship to the wall.

At this point in the program (go to autofunction), the microprocessor MP2 unit sends a signal to load the relays that control the head motors, the tape advance drive motor, the tape cutting motor and pump motors, as well as the opto-isolator circuit for the tape counter. In the function 1 go mode (Fig. 17), all previous automatic updates having been manipulated, the program run cycle is initiated and the program begins. Also in this function 1 go mode the automatic sensor update mode is initiated. In the automatic sensor update there are three sampling loops initiated. In the first sampling loop, the outboard sensors in the head are sampled to determine their positions. These positions are determined by mathematical logic showing the difference in their axial positions (X being horizontal, Y being vertical).

In blade position update, the numerical values of X and Y having been determined, the blades are positioned based on the differences of the X and Y coordinates and the relative angle of fill required to bring the joint to level.

During the automatic update of the sensors, the microprocessor MP2 determines whether or not the blades 211' and 215' are in the position to allow the correct passage of the compound over the blades. This means that the crown of the two finishing blades 211' and 215' is equal through the center and end-to-end thereby being neutral.

Figure 18:
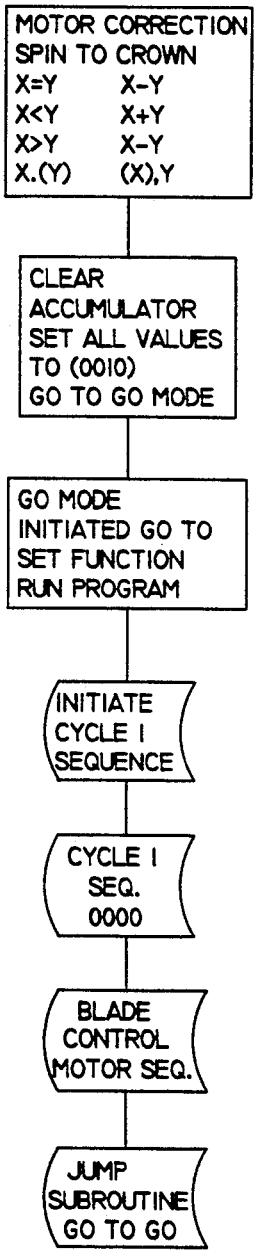
Figure 19:
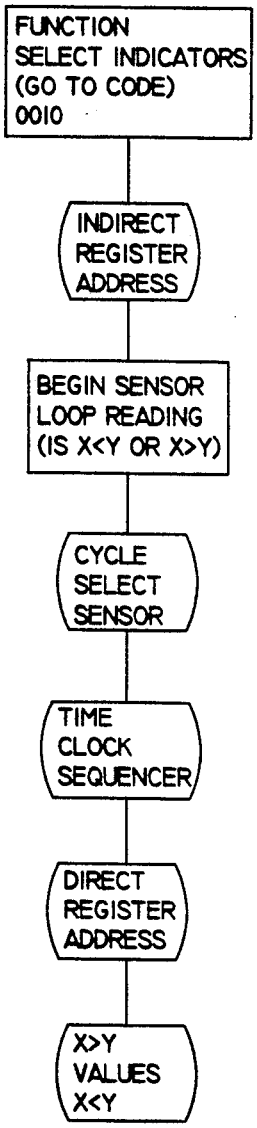
Figure 20:
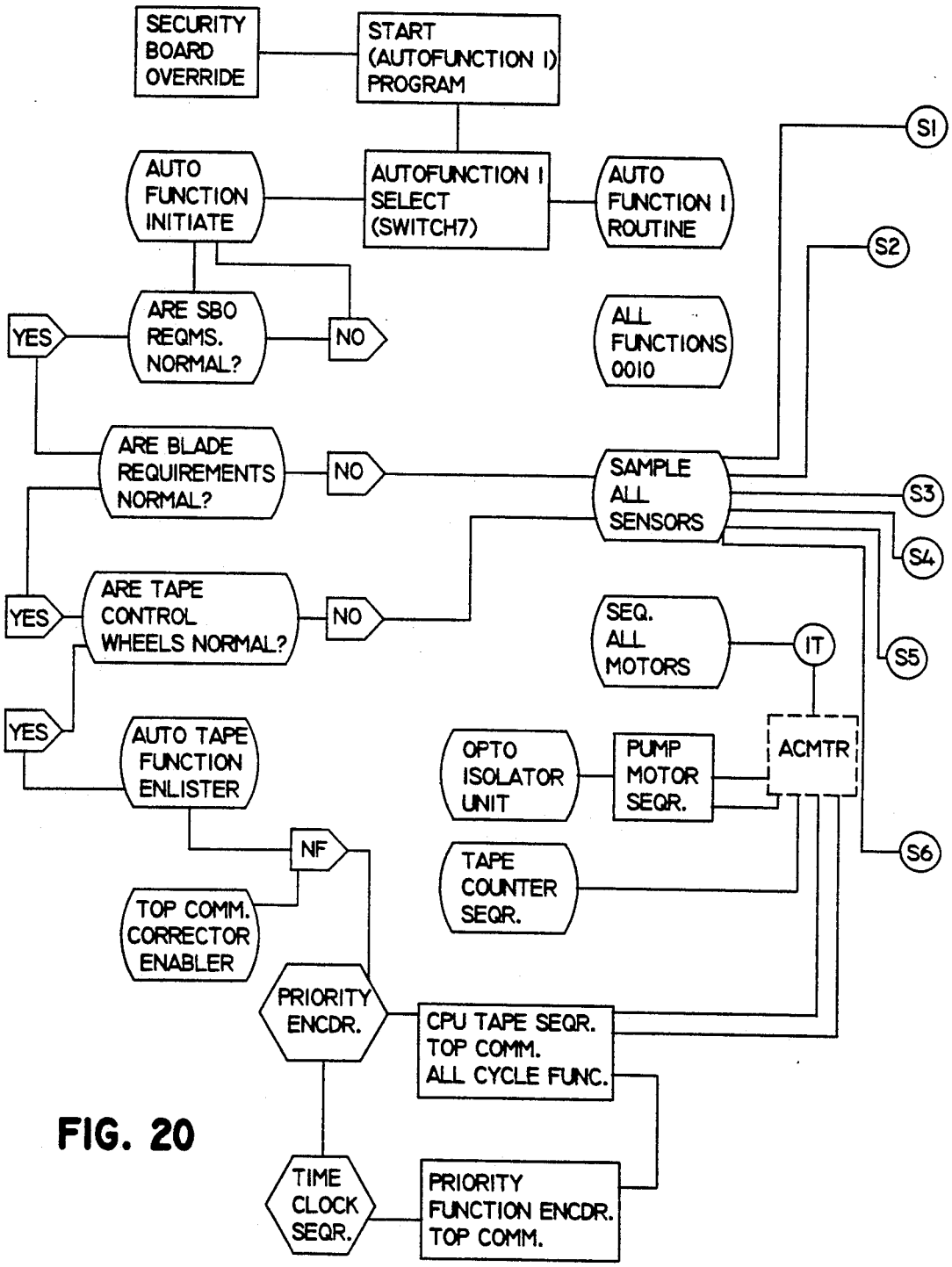
Figure 21:
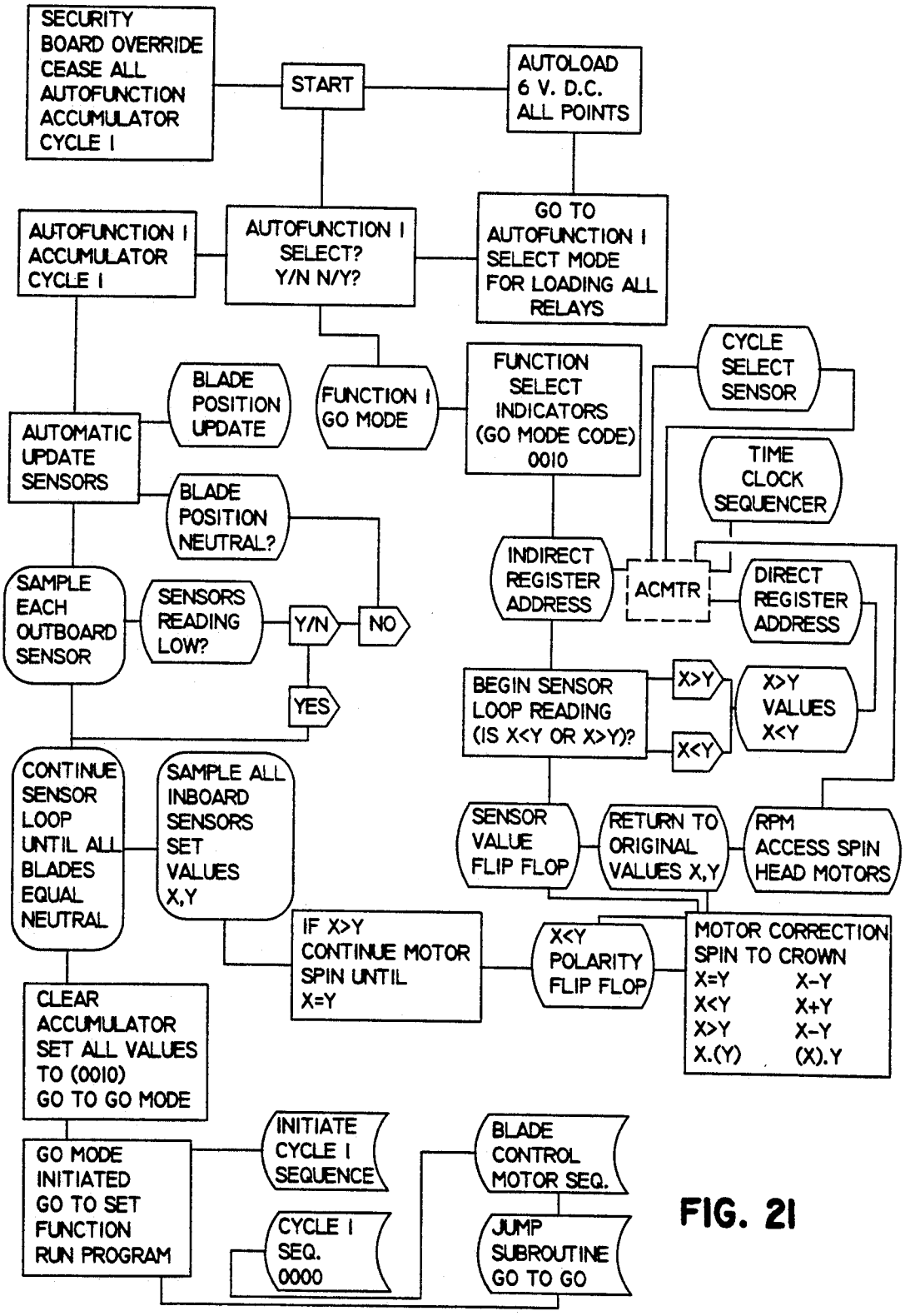
Figure 22:
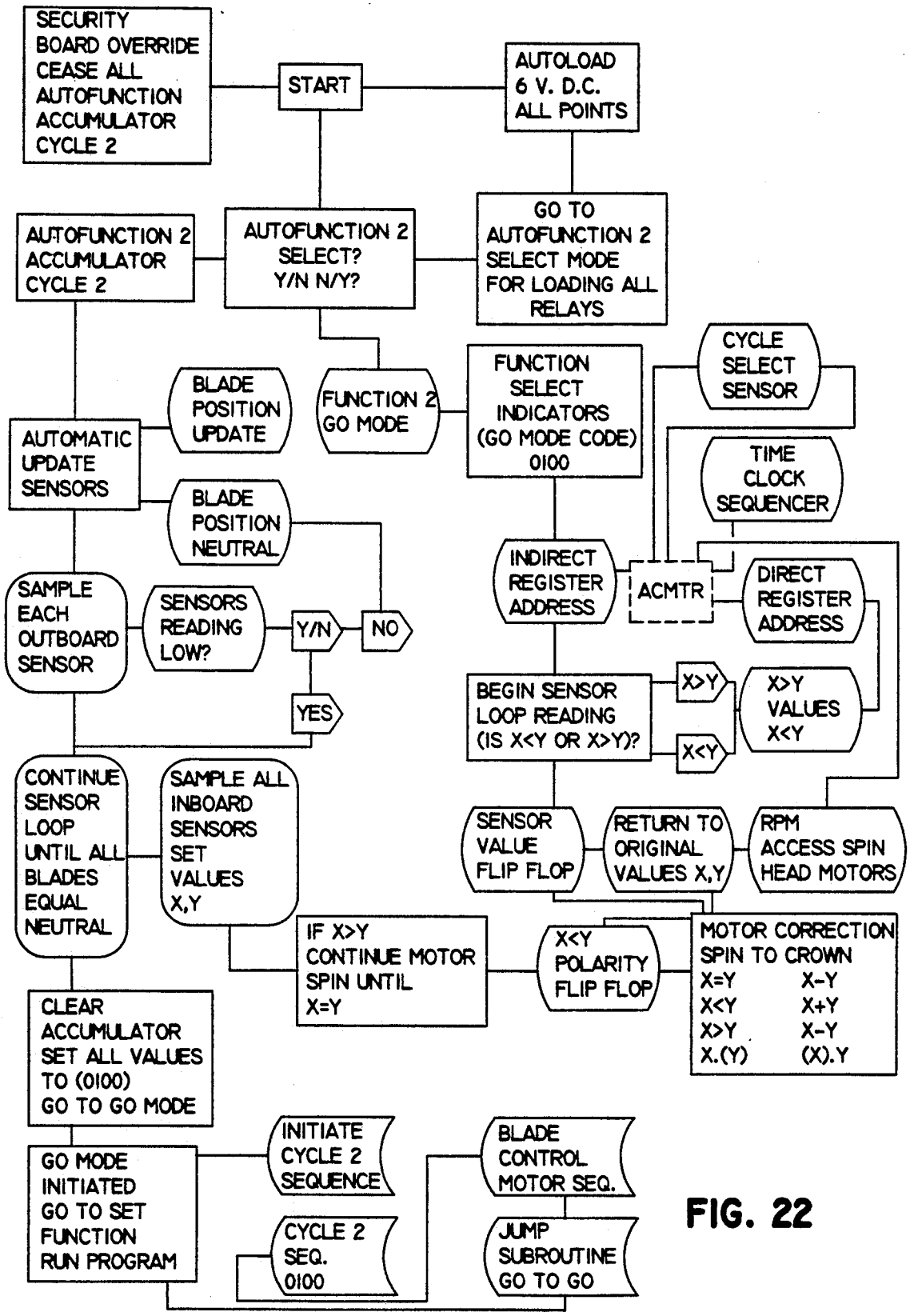

In the second sampling loop, the inboard sensors are sampled to determine their relative heights. If the inboard sensors are reading lower in position than the outboard sensors, then there is a required motor correction to bring the blades to neutral. In this correction there are eight determined relationships examined. These X, and Y values that are fed to microprocessor MP2 are relative positions of the two blades in each head. For instance, in the flat head, the 7"blade is considered to be the primary leading blade and the 10", or the wider blade, is the secondary trailing blade. If these two blades are not pre-crowned correctly, then the trailing blade will remove the compound as it passes the primary blades path. To correct these types of errors, the auto function program is set up to cause each blade to be crowned correctly in relation to the wall. The X and Y values are parabolic gradients. Since the two blades are always crowned either up or down, the program runs two separate loops to determine whether the X value (horizontal relationship) is correct with regards to the Y axis (vertical relationship). This is accomplished by means of the sensors. Each sensor sends to the analog/digital converter a voltage that indicates (along a spectrum of −5 volts to 0 to +5 volts DC) whether or not the sensor quadrant is indicating a low reading (−5 volts DC to 0) indicating a fill requirement or indicating a high reading (0 to +5 volts DC) indicating a removal of excess compound. In FIGS. 18, 21-22, the motor correction sequences are illustrated:

X=Y blades are in neutral position this means that the blades will allow free passage of the compound to the wall surface without interference except to cut the excess compound from the edges of the path. The blades are ½of a degree off in terms of total arc.

X<Y blades are in a concave position relative to the face of the wall. It is in this position the most compound will be left in the center of the joint. The edges however must remain tightly crued so that blades must assume a radical parabolic curve in order to accomplish this. It is under this condition that the heaviest rpm spin to correction occurs.

X>Y occurs as a result of the sensors indicating one side of the joint being higher than the other side. The correction to spin occurs in a manner so as to stagger the relationship of the primary blade and the secondary blade parabolic attitude. This allows more compound to be passed over the low part of the joint while simultaneously removing compound from the high side of the joint.

(x).Y occurs as a result of the sensors indicating the center part of the joint being higher than the outer areas (10" perimeter). The motor correction to spin allows the blades to assume a rippled appearance in relationship to the wall so as to allow the excess compound under the tape to be imbedded further into the wall. This will allow an artificial center to occur, thereby effectively shifting the center of the joint either left or right.

X.(Y) is the opposite of (X.Y) in that it leaves more compound under the tape than in normal situations.

X+Y, X−Y these occur as a result of manual function options which simplify X, Y values to single blade manipulation allowing the operator to choose the blade up function which is X+Y or blades down with is X−Y.

The CLEAR ACCUMULATOR order (FIGS. 21-22) occurs at the beginning of the program sequence in order to set the relative blade and sensor positions in order to start reading the wall surface. If any of the sensors or blades are not operating correctly (overload voltages occurring at any relay points, etc. would indicate either a blade or sensor stuck in position) an audible alarm will sound. The order itself will place everything in a begin reading sequence.

Go mode initiated means simply that the tool has been placed against the wall and relayed information to TOP COM(MP2) causes all tasks performed to be of the priority rating. Go to set function means simply that all sampling routines have begun their set sequence the set routine is sample all sensors outboard to inboard sample all blade position sensors sample all pump sensors average all tape counting sequences and all priority encoder sequences.

Run program occurs when the tool is placed on the wall and drawn along the wall thereby causing input information along the input network to be received at TOP COM(MP1) and acted upon. The microprocessor MP2 initiates cycle 1 sequence meaning that all input information runs in terms of priority. In FIG. 21, cycle 1 is the autofunction 1 program.

Blade control sequence refers to the incoming voltage from TOP COM(MP2) to cause the motors to spin according to a timing sequence which allows them to operate only long enough to correct the crown in the blades based on the incoming information from the sensors.

Jump subroutine occurs in the program for a variety of reasons. For example, if a leak occurs in any of the fluid carrying hoses causing a massive drop in pressure at the head chambers, TOP COM(MP2) will receive PIV at input G causing immediate shut down of all pumping systems. Another jump subroutine would occur if the heads were improperly attached to the control handle effectively shutting off all instructions to the TOP COM shutting the unit down completely.

Function select indicators are autofunction 1, 2 or 3. The tool is in autofunction 1 when the autofunction 1 switch is turned on, etc. Autofunction 1 go to go code 0010, autofunction 2 go to go code 0100. autofunction 3 is 0001. This simply puts TOP COM(MP2) in a routine tasks performance mode.

In the indirect register address all the various subroutines are contained to be used as a comparator for TOP COMs(MP2) input instruction data. This way the computer knows what subroutine task must be performed in order to correct or compensate for prevailing conditions.

The time clock sequencer controls the duration of all motor spin correction. It accomplishes this by receiving incoming data from TOP COM(MP2) and by loading the voltage to the relays for the specific period of time required to effect the correction. Based on sensor input readings from TOP COM time pulse function is inactive.

The DIRECT REGISTER ADDRESS (DAR) receives incoming information from the entire sensor loop as well as pump function loop information. Any of the various subroutine tasks can be performed by means of the sensor loop inputting information into the DAR.

While there has been shown and described preferred embodiments of the invention, it will be appreciated that various modifications and adaptations as come within the spirit and scope of the claims will be apparent to those skilled in the art.

What is claimed:

1. A manually maneuvered automated joint taping apparatus comprising:

remote joint compound supply means having a supply of joint compound and means for pressurizing said supply of joint compound, a taping head assembly for carrying a supply of tape, an initial joint compound spreader nozzle and at least one further joint compound spreader nozzle, and for applying an initial layer of joint compound from said initial joint compound spreader nozzle and tape on said joint and at least one further layer of joint compound from said at least one further joint compound spreader nozzle over said tape, flexible conduit means coupling joint compound under pressure to said initial joint compound spreader nozzle and said at least one further joint compound spreader nozzle on said tape head assembly, means on said taping head for sensing the rate of application of said tape to said joint and producing a rate of tape usage signal, and control means connected to receive said rate of tape usage signal and controlling operation of said means for pressurizing to deliver more or less joint compound to said taping head for application to said joint.

2. The automated joint taping apparatus defined in claim 1 wherein said control means includes microprocessor means.

3. The automated joint taping apparatus defined in claim 2 wherein said taping head includes a tape cutting means for cutting said tape.

4. A manually maneuvered automated joint taping apparatus comprising:

remote joint compound supply means having a supply of joint compound and means for pressurizing said supply of joint compound, a taping head assembly for carrying a supply of tape and for applying an initial layer of joint compound and tape on said joint and at least one further layer of joint compound over said tape, flexible conduit means coupling joint compound under pressure to said tape head assembly, means on said taping head for sensing the rate of application of said tape to said joint and producing a rate of tape usage signal, and control means connected to receive said rate of tape usage signal and controlling operation of said means for pressurizing to deliver more or less joint compound to said taping head for application to said joint, wherein said control means includes microprocessor means, wherein said taping head includes means controlled by said microprocessor for advancing a predetermined length of said tape.

5. The automated joint taping apparatus defined in claim 4, wherein said taping head includes a tape cutting means for cutting said tape.

6. A manually maneuvered automated joint taping apparatus comprising:

remote joint compound supply means having a supply of joint compound and means for pressurizing said supply of joint compound, a taping head assembly for carrying a supply of tape and for applying an initial layer of joint compound and tape on said joint and at least a pair of spaced joint compound spreader nozzles for applying first and second further layers of joint compound over said tape, flexible conduit means coupling joint compound under pressure to said tape head assembly, means on sid taping head for sensing the rate of application of said tape to said joint and producing a rate of tape usage signal, and control means connected to receive said rate of tape usage signal and controlling operation of said means for pressurizing to deliver more less joint compound to said taping head for application to said joint.

7. The automated joint taping apparatus defined in claim 6 wherein there is an upstream joint compound spreader nozzle and a downstream joint compound spreader nozzle and said downstream joint spreader nozzle is wider than said upstream joint compound spreader nozzle.

8. The automated joint taping apparatus defined in claim 6, wherein said pump control means includes microprocessor means.

9. The automated joint taping apparatus defined in claim 6, wherein said taping head includes a tape cutting means for cutting said tape.

10. The automated joint taping apparatus defined in claim 6 including at least one joint compound smoothing blade means downstream of said downstream joint compound spreader nozzle.

11. The automated joint taping apparatus defined in claim 10 including a further joint compound smoothing blade between said joint compound spreading nozzles and having a narrower width than said at least one joint compound smoothing blade means.

12. The automated joint taping apparatus defined in claim 10 wherein said joint compound smoothing blade is shape adjustable and including means in advance of said joint compound spreading nozzles and said joint compound smoothing blade for sensing variation in depth from a predetermined depth and means for adjusting the shape of said joint compound smoothing blade.

13. The automated joint taping apparatus defined in claim 12 wherein said means in advance of said smoothing blade means includes roller means, resilient means for biasing said roller means, means mounting said roller means for tracking variations in depth from said predetermined depth, and said microprocess means translating movement of said roller in response to said variations to control signals and electrical drive means for adjusting the curvature of said adjustable flexible smoothing blade means in accordance with said control signals.

14. The automated joint taping apparatus defined in claim 13 including means for establishing said predetermined depth in said microprocessor, means for supplying said electrical signals to said microprocessor to produce therefrom electrical signals for controlling said electrical drive means.

15. The automated joint taping apparatus defined in claim 14 wherein said microprocessor is programmed to establish a predetermined shape/curvature for said adjustable flexible smoothing blade.

16. The automated joint taping apparatus defined in claim 13 wherein said roller means is constituted by a plurality of rollers arrayed in advance of said float means, each roller being independently biased and including transducer means for transducing variations in movement of its respective roller toward and away from said joint to produce electrical signals at each transducer means, said microprocessor being programmed to scan each of said transducers in a predetermined sequence and control said shape/curvature.

17. A manually maneuvered automated joint taping apparatus comprising:

remote joint compound supply means having a supply of joint compound and means for pressurizing said supply of joint compound, a taping head assembly for carrying a supply of tape and for applying an initial layer of joint compound and tape on said joint and at least one further layer of joint compound over said tape, flexible conduit means coupling joint compound under pressure to said tape head assembly, means on said taping head for sensing the rate of application of said tape to said joint and producing a rate of tape usage signal, control means connected to receive said rate of tape usage signal and controlling operating of said means for pressurizing to deliver more or less joint compound to said taping head for application to said joint, and means for monitoring the overall period of time said automated joint taping apparatus is utilized, and means for disabling said automated joint taping apparatus after the elapse of a predetermined period of time, and external means for resetting said time period and enabling operation of said automated joint taping apparatus.

18. The automated joint taping apparatus defined in claim 17, wherein said pump control means includes microprocessor means.

19. The automated joint taping apparatus defined in claim 16, wherein said taping head includes a tape cutting means for cutting said tape.

20. A manually maneuvered automated joint taping apparatus comprising:

remote joint compound supply means having a supply of joint compound and means for pressurizing said supply of joint compound, a taping head assembly for carrying a supply of tape and for applying an initial layer of joint compound and tape on said joint and at least one further layer of joint compound over said tape, flexible conduit means coupling joint compound under pressure to said tape head assembly, means on said taping head for sensing the rate of application of said tape to said joint and producing a rate of tape usage signal, and control means connected to receive said rate of tape usage signal and controlling operation of said means for pressurization to deliver more or less joint compound to said taping head for application to said joint, wherein said remote joint compound supply is a backpack, including means for mounting same on the back of an operator.

21. The automated joint taping apparatus defined in claim 20, wherein said pump control means includes microprocessor means.

22. The automated joint taping apparatus defined in claim 20, wherein said taping head includes a tape cutting means for cutting said tape.

* * * * *